US007357621B2

(12) United States Patent
Hustvedt et al.

(10) Patent No.: US 7,357,621 B2
(45) Date of Patent: Apr. 15, 2008

(54) CENTRIFUGAL FAN DIFFUSER

(75) Inventors: David C. Hustvedt, Boulder, CO (US); Anders O. Hustvedt, Boulder, CO (US)

(73) Assignee: Acoustiflo, LLC, Boulder, CO (US)

( * ) Notice: Subject to any disclaimer, the term of this patent is extended or adjusted under 35 U.S.C. 154(b) by 222 days.

(21) Appl. No.: 11/359,651

(22) Filed: Feb. 21, 2006

(65) Prior Publication Data

US 2006/0153671 A1 Jul. 13, 2006

Related U.S. Application Data

(63) Continuation of application No. 10/750,604, filed on Dec. 30, 2003, now Pat. No. 7,001,140.

(51) Int. Cl.
*F04D 29/44* (2006.01)

(52) U.S. Cl. ..... 415/224.5

(58) Field of Classification Search ..... 415/1, 415/212.1, 224.5

See application file for complete search history.

(56) References Cited

U.S. PATENT DOCUMENTS

| | | | |
|---|---|---|---|
| 2,053,393 | A | 9/1936 | Clarkson |
| 2,836,347 | A | 5/1958 | Barr et al. |
| 2,987,983 | A | 6/1961 | Solzman |
| 3,140,042 | A | 7/1964 | Noriyoshi |
| 3,365,120 | A | 1/1968 | Jassniker |
| 3,588,270 | A | 6/1971 | Boelcs |
| 3,604,818 | A | 9/1971 | Cronstedt et al. |
| 3,658,437 | A | 4/1972 | Soo |
| 3,759,627 | A | 9/1973 | Ehlinger |
| 3,860,360 | A | 1/1975 | Yu |
| 3,873,232 | A | 3/1975 | Stein et al. |
| 3,905,721 | A | 9/1975 | Fitzpatrick |
| 3,930,746 | A | 1/1976 | Kronogard |
| 3,963,369 | A | 6/1976 | Balje |
| 3,997,281 | A | 12/1976 | Atkinson |
| 4,181,466 | A | 1/1980 | Owen |
| 4,219,305 | A | 8/1980 | Mount et al. |
| 4,269,571 | A | 5/1981 | Shikutani et al. |
| 4,302,150 | A | 11/1981 | Wieland |
| 4,323,330 | A | 4/1982 | Swin, Sr. et al. |
| 4,421,457 | A | 12/1983 | Yoshinaga et al. |
| 4,431,374 | A | 2/1984 | Benstein et al. |
| 4,579,509 | A | 4/1986 | Jacobi |
| 4,626,168 | A | 12/1986 | Osborne et al. |
| 4,770,605 | A | 9/1988 | Nakatomi |
| 4,859,145 | A | 8/1989 | Sidransky |
| 4,877,373 | A | 10/1989 | Bandukwalla |
| 4,900,225 | A | 2/1990 | Wulf et al. |
| 4,946,348 | A | 8/1990 | Yapp |
| 5,064,344 | A | 11/1991 | Kassel et al. |
| 5,141,397 | A | 8/1992 | Sullivan |
| 5,143,514 | A | 9/1992 | Adachi |
| 5,156,524 | A | 10/1992 | Forni |
| 5,316,441 | A | 5/1994 | Osborne |
| 5,417,547 | A | 5/1995 | Harada |
| 5,570,996 | A | 11/1996 | Smiley, III |
| 5,749,702 | A | 5/1998 | Datta et al. |
| 6,146,092 | A | 11/2000 | Botros et al. |
| 6,185,954 | B1 | 2/2001 | Smiley, III et al. |
| 6,203,275 | B1 | 3/2001 | Kobayashi et al. |
| 6,382,912 | B1 | 5/2002 | Lee et al. |
| 6,547,520 | B2 | 4/2003 | Zinsmeyer et al. |
| 7,001,140 | B2 | 2/2006 | Hustvedt et al. |

FOREIGN PATENT DOCUMENTS

JP 55156299 A 12/1980

OTHER PUBLICATIONS

Barina, Frank J., "Comparative Performance of Two Vaneless Diffusers Designed with Different Rates of Passage Curvature for Mixed-Flow Impellers", National Advisory Committee for Aeronautics, Technical Note No. 1490, Nov. 1947, 12 pp.

Bradshaw, Guy R. et al., "Experimental Study of Effect of Vaneless-Diffuser Diameter on Diffuser Performance", National Advisory Committee for Aeronautics, Technical Note No. 1713, Oct. 1948, 29 pp.

Brown, W. Byron et al, "Method of Designing Vaneless Diffusers and Experimental Investigation of Certain Undetermined Parameters", National Advisory Committee for Aeronautics, Technical Note No. 1426, Sep. 1947, 33 pp.

"Control of Flow Separation in Weakly Conducting Liquids by Means of Electromagnetic Forces", www.fz-rossendorf.de, May 27, 2003, p. 1.

Dou, H. S. et al, "Analysis of the Flow in Vaneless Diffusers With Large Width-to-Radius Ratios", Journal of Turbomachinery, Jan. 1998, vol. 120, pp. 193-201.

"Drag of Blunt Bodies and Streamlined Bodies", www.princeton.edu, May 27, 2003, 3 pp.

"Centrifugal Fans", Fan Engineering, Howden Buffalo, Inc., 1999, Ch. 10, pp. 1-17.

Flakt Woods Group, "Centrifugal Fans", www.flaktwoods.com, Jun. 18, 2003, 2 pp.

(Continued)

*Primary Examiner*—Richard A. Edgar
(74) *Attorney, Agent, or Firm*—Santangelo Law Offices, P.C.

(57) ABSTRACT

At least one embodiment of the present inventive technology focuses on a vaneless diffuser adapted for establishment extra-radially of a centrifugal fan, wherein the diffuser may effect an optimal transformation of velocity pressure into static pressure of a fluid (e.g., air) impelled by a centrifugal fan by decreasing that fluid's tangential velocity as it travels through the diffuser, without causing recirculation of air output from the diffuser back into the diffuser. Such diffuser may effect such a decrease in tangential velocity by radially extending the interface through which impelled air is output from the diffuser to a downflow fluid handling environment such as, e.g., a scroll and/or a plenum. The diffuser may converge in a direction parallel with the axis of rotation of the centrifugal fan to avoid fluid recirculation and/or may incorporate acoustical material so as to reduce the amount of material necessary for effective noise reduction as compared with convention noise reduction methods.

21 Claims, 21 Drawing Sheets

OTHER PUBLICATIONS

Haney, Paul, "Boundary Layer", Inside Racing Technology, www.insideracingtechnology.com, Dec. 27, 2000, 4 pp.
Hepperle, Martin, "Euler, Leonard", www.mh-aeortools.de, May 27, 2003, 1 p.
Hepperle, Martin, "Laminar Separation Bubbles", www.mh-aerotools.de, May 27, 2003, 2 pp.
Hepperle, Martin, "Velocity and Pressure Distributions", www.mh-aerotools.de, May 27, 2003, 2 pp.
Jansen, W., "Rotating Stall in a Radial Vaneless Diffuser", Journal of Basic Engineering, Dec. 1964, pp. 750-758.
Japikse, David et al., "Radial Flow Vaneless Diffusers", Diffuser Design Technology, 1998, ch. 5, pp. 121-137.
Johnston, J. P et al, "Losses in Vaneless Diffusers of Centrifugal Compressors and Pumps", Journal of Engineering for Power, Jan 1966, pp 49-62.
Lee, Yu-Tai et al., "Direct Method for Optimization of a Centrifugal Compressor Vaneless Diffuser", International Gas Turbine & Aeroengine Congress & Exhibition, Munich, Germany, May 8-11, 2000.
Lee, Yu-Tai et al., "Direct Method for Optimization of a Centrifugal Compressor Vaneless Diffuser", Journal of Turbomachinery, Jan. 2001, vol. 123, pp. 73-80.
Pace Performance Air, "Un-housed Plug Fan Efficiency", Apr. 1995, 2 pp.
Senoo, Yasutoshi et al., "Asymmetric Flow in Vaneless Diffusers of Centrifugal Blowers", Journal of Fluids Engineering, Mar. 1977, pp. 104-114.
Sonwalkar, Nishikant, "Boundary Layer at a Stagnation Point", www.mas.ncl.ac.uk, Feb. 16, 1995, 3 pp.
Sonwalkar, Nishikant, "Boundary Layer Separation", www.mas.ncl.ac.uk, Feb. 16, 1995, 3 pp.
Tsurusaki, Hiromu et al., "A Study on the Rotating Stall in Vaneless Diffusers of Centrifugal Fans", JSME International Journal, 1987, vol. 30, No. 260, pp. 279-287.
Tsujimoto, Yoshinobu et al., Study of Vaneless Diffuser Rotating Stall Based on Two-Dimensional Inviscid Flow Analysis, Journal of Fluids Engineering, Mar. 1996, vol. 118, pp. 123-127.

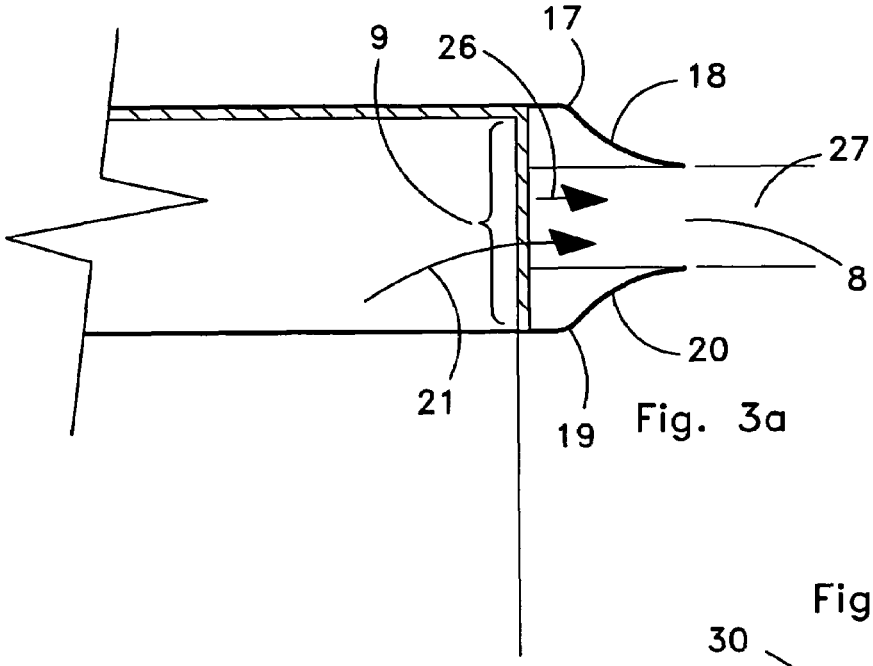
Fig. 3a
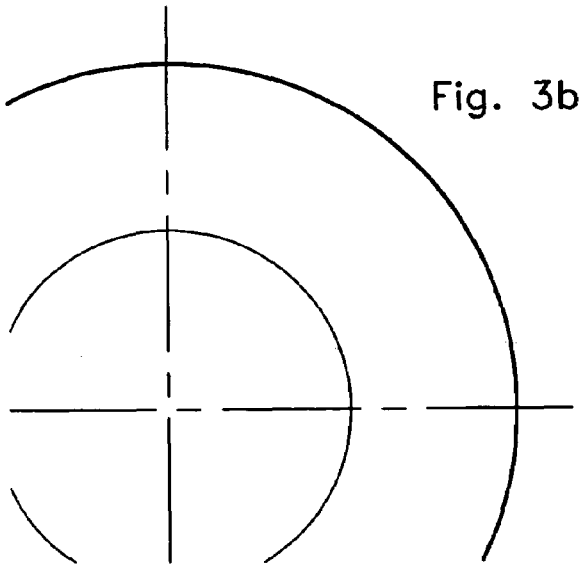
Fig. 3b
Fig. 3c
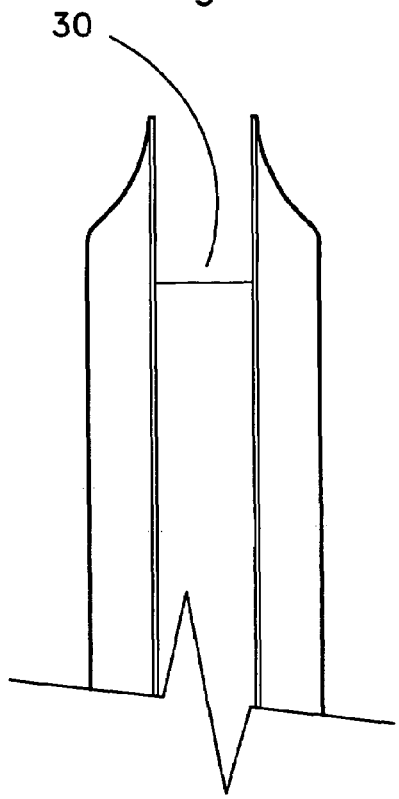

Momentum Diffusion Shroud

Velocity Plot: Velocity (ft/s)

CENTRIFUGAL FAN DIFFUSER

CROSS-REFERENCES TO RELATED APPLICATIONS

This application is a continuation application of, and claims the benefit and priority of, U.S. patent application Ser. No. 10/750,604, filed Dec. 30, 2003, published on Jun. 30, 2005, as US publication number US 2005-0141988 A1, issuing Feb. 21, 2006 as U.S. Pat. No. 7,001,140, which was a United States nonprovisional application, the above-mentioned application hereby incorporated by reference.

BACKGROUND OF THE INVENTION

Generally, this invention relates to fluid handling methods and apparatus usable to enhance the performance of centrifugal fan systems. Specifically, the invention focuses on fluid handling methods and apparatus that involve a novel fluid diffuser that can be used to increase the static pressure of an impelled fluid beyond that increase observed using conventional diffusion methods and apparatus. A preferred embodiment involves a vaneless diffuser that converges air passing through it as it radially extends an interface through which this air is output to a downflow air handling environment.

As a brief technical overview, a centrifugal fan discharge has both a radial (e.g., in a direction perpendicular to the axis of rotation of the impeller) and usually also a tangential velocity component (e.g., tangential to a curve such as a circle traced by the rotating impeller); an axial fan discharge has both an axial (e.g., parallel with the axis of rotation of the impeller) and tangential velocity component; a mixed flow fan discharge has tangential, radial and axial velocity components.

Centrifugal fans exist in a variety of configurations. They may be either contained or housed within scrolls (e.g., circular scrolls) for pressure recovery or direct connection to a duct system, or un-housed (e.g., un-scrolled) for use in pressurizing plenums or large volumes. Pressure recovery in a scroll generally refers to recovery of static pressure upon a decrease of an air speed in a direction parallel with a centerline of the flow area of the scroll's substantially uni-directional diffusing section. Centrifugal fans may be further distinguished among themselves by the discharge angle of the fan blades relative to the radial direction. Radial blades discharge fluid (including gas, which itself includes air) in the radial direction. Backward curved blades cause fluid to discharge more in a direction opposite rotation and produce the highest static pressure (for a given amount of input work) as compared with other blade configurations. Forward curved blades discharge fluid more in the direction of fan rotation and have the highest tangential discharge velocity and the smallest static pressure production for a given rotational speed and fan diameter. In other words, as compared with backward curved fans, more of the work done on the fluid by forward curved fans is observed as fluid velocity instead of static pressure.

The desire to maximize the increase in static or pumping pressure of a fluid impelled by a centrifugal fan has been known for many years. It is well acknowledged that it is static pressure and not dynamic pressure of a fluid output by a centrifugal fan system that is more valuable and useful for the intended purposes of most if not all centrifugal fan applications (e.g., supplying air to ducts for eventual release to rooms in a building). Conventional attempts to increase the amount of fluid energy observable as static pressure have resulted in scroll diffusers that seek to increase the cross-sectional flow area of the scroll's unidirectional diffusing section so as to cause a decrease in the speed of the fluid that is parallel with the centerline of the flow area of the scroll's diffusing section, and thereby decrease the dynamic pressure of the fluid. This decrease in dynamic or velocity pressure results in an increase in the static pressure of the fluid because of conservation of energy principles, (see, e.g., U.S. Pat. No. 6,185,954). However, such a diffuser is not without its problems. Not only is it limited in application to scrolled fans and ducted collection systems, but it typically requires a diffuser (e.g. a "jetting" extension) that is so long (e.g., several times the diameter of the fan) that it complicates installation. Maldistribution of airflow often observed in the ducted diffuser section may also lead to less efficient conversion of velocity to static pressure.

Unhoused centrifugal fans, called plenum fans or, when a backwardly inclined airfoil blade is used, plug fans, are also used in many applications for ventilation and material handling (e.g., the pumping of solid materials such as sawdust). These fans are installed in relatively large volumes such as plenums that may be several times the diameter of the fan. It is important to take note of the prevailing attitudes towards opportunities to recover static pressure in unhoused centrifugal fans. As reported in literature describing the application of such centrifugal fans (ASHRAE Journal, October 1997, C. W. Coward; Pace Company Technical Report, April 1995) the velocity pressure produced at the discharge of these unhoused (e.g., unscrolled) "plug" fans is "for all practical purposes, zero" (due to the large outlet area of such unscrolled fans), and therefore is not available for transformation or conversion so as to increase the static pressure of the discharge. The Pace Company document further states that:

> There is no static pressure regain when using an unhoused plug fan and Pv equals zero . . . Documents which indicate efficiencies near or above 80% are most certainly based on tests of a fan wheel in a scroll. In order to achieve the submitted efficiency, a scroll must be employed . . . Pace's opinion is that the absence of a scroll housing limits the mechanical efficiency of a plug fan to somewhere in the low 70's. It is quite doubtful that one exists which performs much better. It is, therefore, our recommendation that uses of unlicensed products with efficiencies in excess of 75% should be avoided unless some clearly identifiable innovation or design change has been implemented. ASHRAE Journal, October 1997, C. W. Coward; Pace Company Technical Report, April 1995

These comments reflect the prevailing opinion of those experienced in the art of centrifugal fans and clearly "teach away" from the invention described herein by suggesting that increasing the static pressure of an unscrolled centrifugal fan by capturing energy from the fan's outlet velocity is simply not possible. However, at least one embodiment of the present invention increases the static pressure of an unscrolled centrifugal fan by doing precisely that—converting the fan's outlet velocity energy (specifically the tangential velocity pressure) to static pressure. This manner of fan performance improvement is in direct contravention to the prevailing opinion of those experienced in the art, as expressed in the Pace Company document. In general it appears that there are no devices currently in use or discussed in the literature that allow recovery of velocity pressure from plenum or plug fans to the degree now possible. At least one embodiment of the present invention effects an efficiency in excess of 75%, and indeed in excess of 80%, without the use of a scroll and its related disadvantages. Indeed, "a clearly identifiable innovation or design change" inheres in the instant inventive technology.

Vaneless diffusers have been the subject of analysis and experimentation as applied to centrifugal compressors since the 1940's (see, e.g., J. D. Stanitz, NACA TN 2610 (1952); J. P. Johnston, "Losses in Vaneless Diffusers of Centrifugal Compressors and Pumps" ASME Journal of Engineering for Power, 1966; H. S. Dou, "Analysis of the Flow in Vaneless Diffusers with Large Width-to-Radius Ratios", ASME Journal of Turbomachinery, 1998). However, none of these references discloses or investigates the optimization of vaneless diffusers to effectively recover velocity pressure. The central focus appears merely to be the unsteady flow behavior in vaneless diffusers at the onset of rotating stall Where vaneless diffusers are mentioned in conjunction with a centrifugal fan, there is no disclosure relative to optimization of vaneless diffusers (via, e.g., axially converging oppositely facing diffuser forms as a radial distance from a centrifugal fan rotation axis increases) to effectively recover static pressure from centrifugal fans.

The mechanics of vaneless diffusers applied to centrifugal compressors or pumps has been documented in the technical literature (see, e.g. Diffuser Design Technology, David Japikse, 1998 and other papers referenced above). As pointed out above, conventional thinking (as indicated by the 1995 Pace Co. technical report) was that fluids discharged by unscrolled centrifugal fans did not present an opportunity to increase static pressure. As such, vaneless diffusers used with centrifugal fans were designed merely to prevent rotating stall, e.g., and were not in any way shaped to optimize and/or enhance velocity pressure recover. Indeed, the only known vaneless diffusers used with centrifugal fans are parallel plates. (see, Tsurusaki, H., et al., "A Study on the Rotating Stall in Vaneless Diffusers of Centrifugal Fans", ISME International Journal, 1987, Vol. 30, No. 260., pp. 279-287).

But as reported in the literature (See Japikse, supra, or NACA TN2610, 1952), such vaneless diffusers are relatively inefficient when applied to pumps or compressors (each of which have significantly higher operative pressure regimes than those of centrifugal fans and are designed to operate on primarily radial flow). Essentially, boundary layer effects dominate the flow field inside the centrifugal compressor's diffuser and lead to flow separation and reversal, and higher viscous losses because of the relatively narrow flow path Examples of vaneless diffusers applied to centrifugal compressors include U.S. Pat. No. 6,382,912 (Lee and Bein), which disclosed a particular wall contour having a pinchpoint for optimizing the performance of a vaneless diffuser connected to a compressor. U.S. Pat. No. 6,382,912 relies on the reduction of radial velocity to achieve an increase in static pressure.

A recent analysis (Yu-Tai Lee, "Direct Method for Optimization of a Centrifugal Compressor Vaneless Diffuser" ASME Journal of Turbomachinery, 2001) reported a method for optimizing a vaneless diffuser for centrifugal compressors. The technique reported is embodied in the above-mentioned U.S. Pat. No. 6,382,912. The flow regime imposed by the compressor is predominantly radial and compressible (Mach number in excess of 1.0), and the flow passage is extremely narrow compared to the diffuser's length of radial extension. The optimization approach is based on fixing the outlet dimensions of the diffuser and optimizing the radial velocity diffusion by optimally shaping one surface of the diffuser. As will be seen by subsequent discussion, this approach is vastly different from that of at least one embodiment of the present invention, in which optimal performance is achieved by adjusting the diffuser contour and outlet dimensions to prevent problems associated with (or related to) recirculation of the radial velocity component while maximally diffusing the tangential velocity component, these problems including but not limited to energy losses. Further, as explained above and below, the centrifugal compressor and the centrifugal fan flow regimes are vastly different.

Centrifugal fans differ from centrifugal compressors in several important ways. First of all, the axial dimension (parallel to the fan's axis of rotation) or axial length of the fan output space (roughly the width of the fan wheel) is significantly larger. As a result, the diffuser flowpath 5 of a centrifugal fan is less dominated by boundary layer effects than in a diffuser used with a centrifugal compressor. Additionally, centrifugal fans operate at speeds and pressures at which the behavior of impelled, flowing fluid 6 (e.g., air 7) may usually be appropriately modeled by ignoring compressibility effects (i.e., assuming an incompressible fluid), in addition to ignoring heat transfer effects. However, such an assumption is entirely inappropriate for centrifugal pumps and compressors.

Other distinctions relative to a centrifugal fan's operative regime as compared with the operative regime of centrifugal compressors are as follows: as but one initial distinction, the typical rotational speed of a centrifugal compressor is orders of magnitude (e.g., 10 times, 100 times) greater than that of a centrifugal fan (a typical upper speed limit of centrifugal fans may be 2000-3000 RPM (revolutions per minute) while a typical speed range of centrifugal compressors may be 10,000 to 100,000 RPM). Centrifugal fans typically effect a static pressure rise (in inches of water) of less than 10 inches, while centrifugal compressors typically effect a pressure rise of greater than 60 inches. Such pressure-related differences constitute one reason why flow behavior of a fluid impelled by a centrifugal fan can often be adequately predicted and/or modeled under an incompressible flow assumption, while such an assumption may be entirely inappropriate in predicting the operative response of a centrifugal compressor, particularly where the fluid is a gas such as air. Compressibility effects become significant (i.e. greater than a 5% change in fluid density for air) at Mach numbers greater than 0.3. According to Japikse (See *Centrifugal Compressor Design and Performance*, Japiske, 1996) compressors have tip Mach numbers from 0.6 to above 1.0; centrifugal fans have Mach numbers less than 0.3. Such reflects a fundamental difference in the two types of turbomachinery and in the operative response of a fluid impelled by each of them. Further, as indicated, the flow regime in a centrifugal compressor and a centrifugal pump (and through conventional diffusers that may be used in conjunction with them) is primarily radial whereas, in a preferred embodiment of the instant application, the flow regime of and the output from the centrifugal fan (and through at least one embodiment of the inventive diffuser that may be used in conjunction with a centrifugal fan) is primarily tangential.

FIG. 4 shows a Cordier Plot relating dimensionless values of turbomachinery for "well designed" units. It is but one indicator of the fundamental differences of centrifugal fans from centrifugal compressors. The Cordier Plot shows a graph of specific diameter (y-axis) vs. specific speed (x-axis), where specific diameter=(head rise coefficient^¼)/(flow coefficient^½), where head rise coefficient=g(head rise)/(((rpm speed)^2)(diameter^2)), and flow coefficient=flow volume/((rpm speed)(diameter^3)). In the 1950's, Cordier found that well-designed turbo-machines fall on the curve of the Cordier Plot of FIG. 4. As shown by this graph, centrifugal fans typically have a specific diameter of between 2 and 4. Additionally, they have lower pressures than centrifugal compressors, and significantly wider flow paths than compressors and thus, their operation can be improved by the incorporation of a vaneless diffuser. On the other hand, centrifugal compressors, which have specific diameters greater than four and fairly narrow flow paths, are not particularly suited for use with vaneless diffusers. The narrow flowpath of any vaneless diffuser that would be used with the centrifugal compressors would cause significant viscous and frictional losses, thereby compromising any increase in static pressure.

Such above-mentioned fundamental differences alone and in combination render the two types of turbomachinery and the flow behavior of fluid impelled by them sufficiently and fundamentally different, enough so that one would not expect that performance enhancing design features of one of the types of turbomachinery would necessarily enhance performance of the other. Indeed, such would be entirely unexpected.

U.S. Pat. No. 4,323,330 (1982) discloses use of a vaneless diffuser with a mixed flow fan in which impelled air has a radial , axial and tangential velocity. However, the diffuser described in U.S. Pat. No. 4,323,330 relies on changes in effective flow area to reduce axial and radial velocity of impelled air—it does not cause the greater part of its increase in static pressure by reducing tangential velocity—a key feature of at least one embodiment of the present invention. As but a few additional distinctions, the mixed flow fan diffuser of U.S. Pat. No. 4,323,330 does not rely on conservation of angular momentum principles to effect an increase in static pressure (as does at least one embodiment of the present invention); the mixed flow fan diffuser of U.S. Pat. No. 4,323,330 axially diverges air flow (instead of axially converging it as in at least one embodiment of the present invention); the mixed flow fan diffuser of U.S. Pat. No. 4,323,330 includes a partial flow obstructing structure (see parts 48, the "vertically extending orifice portion" and 48c); the mixed flow fan diffuser of U.S. Pat. No. 4,323,330 does not smoothly direct impelled air flow; and the mixed flow fan diffuser of U.S. Pat. No. 4,323,330 generates a flow regime (a mixed flow) that includes an axial component and that is therefore entirely different from the centrifugal fan flow regime of at least one embodiment of the present invention. Even though the mixed fan of U.S. Pat. No. 4,323,330 produces tangential velocity, that patent does not disclose decreasing the tangential velocity to increase static pressure. Instead, its mode of pressure recovery is disclosed by its Diagram b and the related discussion of column 2, lines 10-27, in which there is only reference to the principle of conservation of energy and none to the principle of conservation of angular momentum. That U.S. Pat. No. 4,323,330 does not disclose decreasing the tangential velocity to increase static pressure is particularly evident upon consideration of the patent's disclosure relative to rotating diffuser plates, as such rotating plates would expectedly increase the tangential velocity (in stark contrast to the regain of static pressure effected by a decrease in tangential velocity as seen in the stationary diffuser of a preferred embodiment of the instant invention). Not only does the invention described in U.S. Pat. No. 4,323,330 focus on increasing flow area to recover static pressure from other than tangential velocity, but it does not appear to have the radial extension necessary to reduce tangential velocity, and it does not address controlling the radial velocity in an manner. Indeed, U.S. Pat. No. 4,323,330 illustrates how the manipulation of tangential velocity to increase static pressure was not well considered prior to the present invention.

A clearly evident problem with conventional diffusers may be that none seeks to manipulate both radial velocity and tangential velocity of an impelled fluid output by the centrifugal fan in order to maximize the static pressure recovery, as is seen in at least one embodiment of the instant inventive technology. As such, conventional centrifugal diffusers do not achieve optimal or maximal static pressure recovery.

Vaned diffusers have been proposed for recovery of velocity pressure but have poor off-design performance and as they recover relatively little static pressure, have very low recovery efficiency (which may be defined as the percentage of dynamic pressure at the diffuser inlet that is converted to static pressure). Vaned diffusers are offered commercially in conjunction with centrifugal fans but because of the poor performance discussed above, have not been widely applied.

A common current practice to recover velocity pressure in centrifugal fans is to use curved impeller blades to direct the outlet flow from these fan blades towards a direction opposite fan rotation. This redirection has the effect of reducing the discharge tangential velocity of air leaving the fan and thereby increasing the static pressure produced by the fan. Such fans, called backward inclined or backward curved, produce higher static pressure as compared with that static pressure resulting from fans with blades that are configured in a manner other than backward curved but, because of geometric and practical limitations, still typically produce substantial tangential velocity (regardless of what the Pace Company document states) whose energy is not transformed to static pressure. Relatedly, a disadvantage of this approach is that, in comparison with the approach of at least one embodiment of the instant inventive technology disclosed herein, it the requires larger or higher speed wheels to achieve a given static pressure (because as is well understood, the change in total fluid pressure across the fan is proportional to the change in tangential velocity across the fan.).

At least one embodiment of the inventive technology described herein may be applied in any type of centrifugal fan to recover velocity pressure at an enhanced recovery efficiency. However, fans with greater tangential velocities at the discharge (e.g. radial or forward curved fans) offer greater potential for recovery of velocity energy. In addition, the diffuser of at least one embodiment of the present invention can involve shaping, customization or matching to relative to fan characteristics of blade angle, wheel width, and rotational speed in order to perhaps even further optimize the increase in static pressure.

SUMMARY OF THE INVENTION

The present invention includes a variety of aspects which may be combined in different ways. In one basic form the invention discloses the use of an inventive vaneless diffuser extra-radially of a centrifugal fan, wherein the diffuser effects an optimal transformation of velocity pressure into static pressure of a fluid such as air impelled by a centrifugal fan by decreasing the tangential velocity of that fluid as it travels through the diffuser, while adjusting the internal sides of the diffuser so as to avoid recirculation of air output from the diffuser back into the diffuser. Such diffuser may effect such a decrease in tangential velocity by radially extending the interface through which impelled air is output from the diffuser to a downflow fluid handling environment such as, e.g., a scroll and/or a plenum that is established downflow of the diffuser. In a preferred embodiment, such radial extension does not involve the impartation or deletion of significant amounts of energy to or from the fluid (other than that loss attributable to friction). Such diffuser may converge in a direction parallel with the axis of rotation of the centrifugal fan as distance from the axis of rotation increases (axial convergence). The diffuser may incorporate acoustical material in some manner, and, as compared with conventional acoustical treatment methods, may reduce the amount of material necessary for effective noise reduction. Of course, these are but a few features of certain embodiment(s) of the inventive technology. Naturally, as a result of these several different and potentially independent aspects of the invention, the objects of the invention are quite varied.

One broad goal of at least one embodiment of the invention is to save costs related to power consumption during fan operation and, perhaps, costs for a centrifugal fan unit by providing a diffuser that enables the achievement of the same performance (e.g., the same pressure rise) as that achieved by a prior art fan that does not incorporate the instant invention's diffuser, but with a smaller (as gauged by horsepower or impeller size) unit, perhaps operating at a lower speed. Power consumption can be reduced by perhaps 20%, 30%, or even as much as 50%, and, relatedly, overall performance efficiency of a conventional centrifugal fan can be increased from 60-65% to perhaps 85-90% (thus, fan system efficiency can be increased by 20% to 40%). Fan system (which includes a diffuser) efficiency may be defined as the ratio of air power (output) from the diffuser to shaft power requirement (input). With a reduced shaft power requirement, there is a reduction in energy consumption.

$$\text{Fan System Efficiency} = \frac{\text{Static Pressure Rise} \times \text{Volumetric Flow Rate}}{\text{Shaft Power}}$$

where the static pressure rise is from fan input to diffuser output.

Regardless of whether: (a) a diffuser unit is retrofitted onto an existing centrifugal fan, enabling the same performance at reduced speed (thus resulting in cost savings); or (b) a centrifugal fan and inventive diffuser are used instead of a conventional fan assembly (either centrifugal fans alone or centrifugal fans in conjunction only with conventional scroll diffusers) to achieve a certain design performance, the inventive diffuser can lead to substantial operation and/or installation cost savings as compared with conventional centrifugal fan assemblies. Applications include centrifugal fan HVAC, rooftop centrifugal fan systems, centrifugal plenum fans, housed centrifugal fans having scroll collection devices, centrifugal fan powered HEPA filtration systems, centrifugal fan filter units, centrifugal fans with filtering and/or conditioning systems as but a few particular examples, and, generally, any unit or system involving a centrifugal fan.

One broad goal of at least one embodiment of the invention is to improve fan stability during operation by diffusing fluid extra-radially of the fan impeller blades, and without vanes. A vaneless design may decrease diffuser costs, reduce the amount of frictional losses, result in less noise, and/or increase the degree and amount of static pressure recovery.

One broad goal of at least one embodiment of the invention is to increase the amount of static pressure recovered (e.g., by increasing the amount of dynamic pressure "transformed" to static pressure and/or by increasing the amount of energy input into the fluid that is observed as static pressure at the diffuser or fan outlet) using the inventive diffuser in conjunction with a centrifugal fan, as compared with conventional centrifugal fans (with or without any conventional diffuser devices that may exist).

One broad goal of at least one embodiment of the invention is to optimize (i.e., maximize) the amount of static pressure recovered from the velocity pressure of a fluid impelled by a centrifugal fan, thereby optimizing static pressure recovery (or static recovery) and recovery efficiency.

One broad goal of at least one embodiment of the invention is to reduce the amount of acoustical material and treatment necessary to sufficiently quiet the noise produced by a centrifugal fan and/or the diffuser and/or a scroll collection system.

One broad goal of at least one embodiment of the invention is to effect the greatest part of the increase in static pressure due to a diffuser by decreasing tangential velocity of a fluid impelled by a centrifugal fan.

One broad goal of at least one embodiment of the invention is to transform tangential velocity of a fluid impelled by a centrifugal fan into static pressure in a manner that prevents recirculation of fluid external to the diffuser back into the diffuser.

One broad goal of at least one embodiment of the invention is to achieve (or improve) the fan efficiency of a relatively expensive backward inclined fan with a smaller, less-expensive forward curved or radial centrifugal fan in conjunction with an inventive diffuser.

One broad goal of at least one embodiment of the invention is to provide a diffuser usable with a centrifugal fan that is vaneless and, as such, does not require an outlay of costs typically associated with the vanes of a vaned diffuser.

One broad goal of at least one embodiment of the invention is to transform tangential velocity of a fluid impelled by a centrifugal fan into static pressure while simultaneously keeping radial velocity of the fluid output from a diffuser above certain lower limit.

One broad goal of at least one embodiment of the invention is to facilitate the termination of flow through the fan when the fan is not operating. Specifically, this goal is to provide axially movable diffuser forms that can sufficiently obstruct flow (including backflow or leakage through a fan) upon actuation. A related goal is to eliminate the disadvantages (e.g., energy loss and wasting, including pressure loss) associated with conventional dampers positioned external to the fan. It should also be noted that such axially movable diffuser forms also could allow a fan operator (perhaps via manual operation or by automation) to further improve the performance of the combined diffuser/fan unit in the field because the efficiency of the diffuser is a function (at least in part) of the spacing between the oppositely established diffuser forms through which impelled air discharged from the centrifugal fan flows. Thus, it is an object of at least one embodiment of the inventive technology to enable further improvement of the performance of the inventive diffuser by providing an ability to adjust the spacing between the oppositely established diffuser forms.

Naturally, further objects and features of the invention are disclosed throughout other areas of the specification and claims.

BRIEF DESCRIPTION OF DRAWINGS

FIG. 3*a* shows a cross-sectional view of at least one embodiment of the inventive diffuser as adjoined with a centrifugal fan.

FIG. 3*b* shows an elevation plan view of at least one embodiment of the inventive diffuser as adjoined with a centrifugal fan.

FIG. 3*c* shows a side view of at least one embodiment of the inventive diffuser.

FIG. 10 shows a graph of regain effectiveness vs. diffuser area ratio (referred to as outlet area ratio) for a variety of area ratios and specific fan and diffuser parameters (18-inch diameter diffuser attached to an 8-inch diameter radial discharge fan delivering 720 cubic feet per minute and operating at various rotational speeds).

DETAILED DESCRIPTION OF THE PREFERRED EMBODIMENTS

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and preferred embodiments should not be construed to limit the present invention to only the explicitly described systems, techniques, and applications. Further, this description should further be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 7:
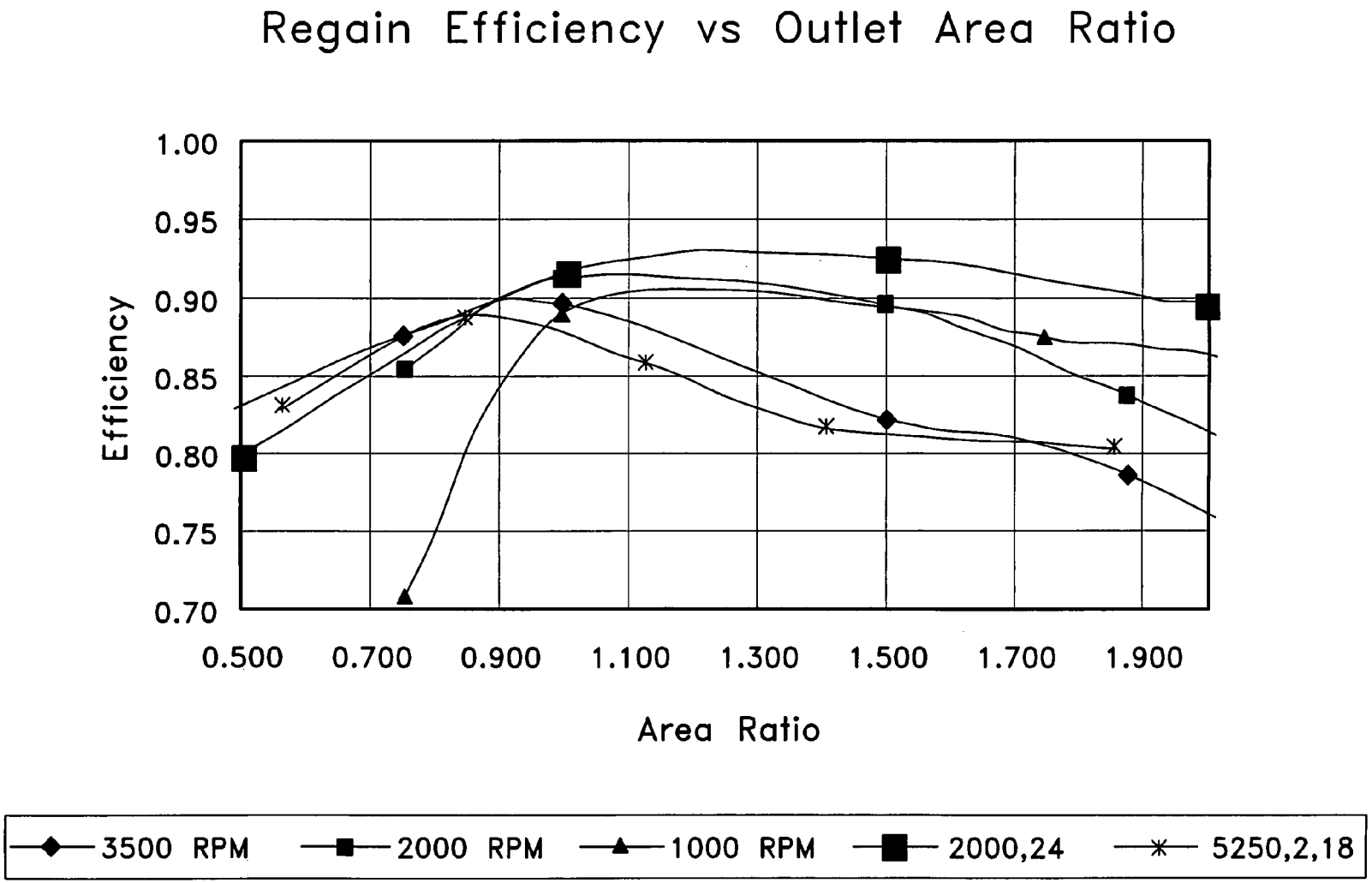
FIG. 7 shows a graph of a dimensionless regain efficiency vs. diffuser area ratio (referred to as outlet area ratio) for a variety of area ratios for a given set of specific fan and diffuser parameters (18-inch diameter diffuser attached to an 8-inch diameter, 3-inch high radial discharge fan delivering 720 cubic feet per minute and operating at rotational speeds of 3500, 2000, and 1000 revolutions per minute). The same fan operating at 2000 revolutions per minute but with a 24-inch diameter diffuser is shown as the "2000,24" line. A 2-inch high fan with an 18-inch diffuser and operating at 5,250 revolutions per minute is shown as the "5250,2,18" line.
Figure 8:
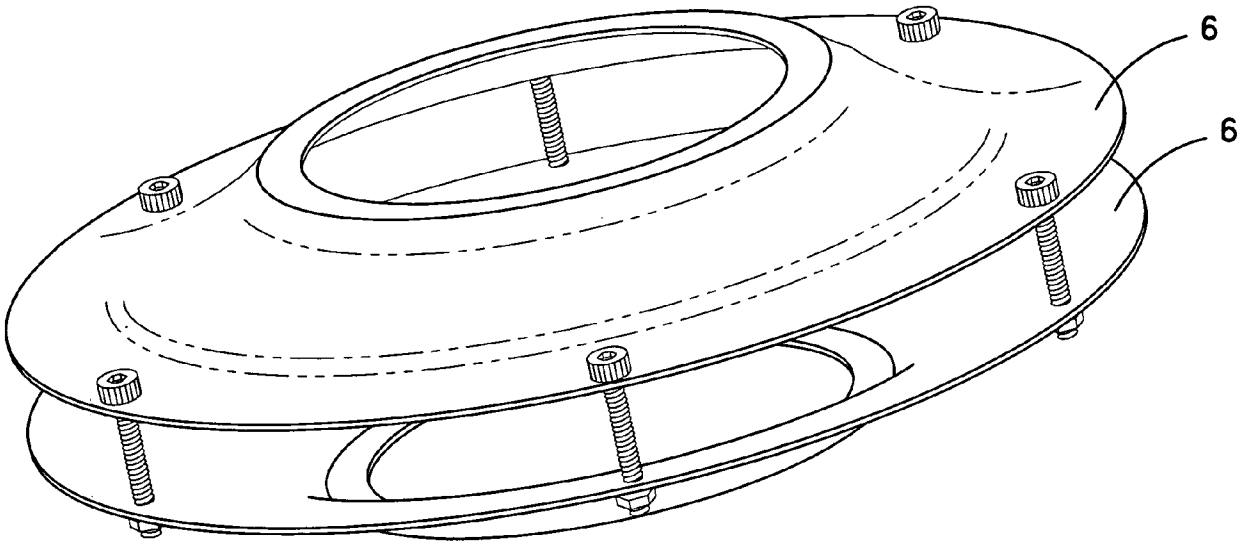
FIG. 8 shows a perspective view of at least one embodiment of the inventive diffuser apart from a centrifugal fan.
Figure 9A:
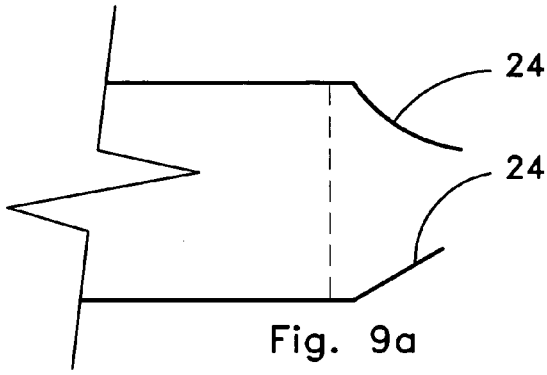
FIG. 9 shows partial cross-sectional views of various embodiments of the inventive diffuser attached to a centrifugal fan.
Figure 9B:
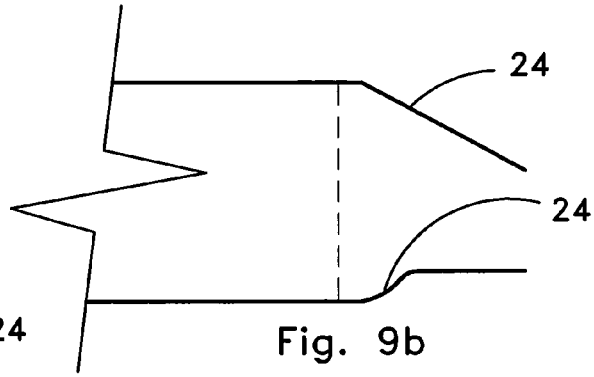
Figure 9C:
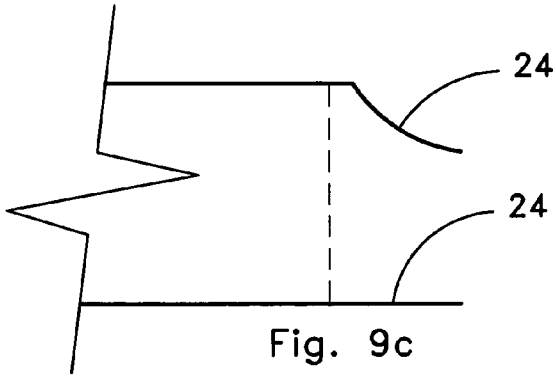
Figure 9E:
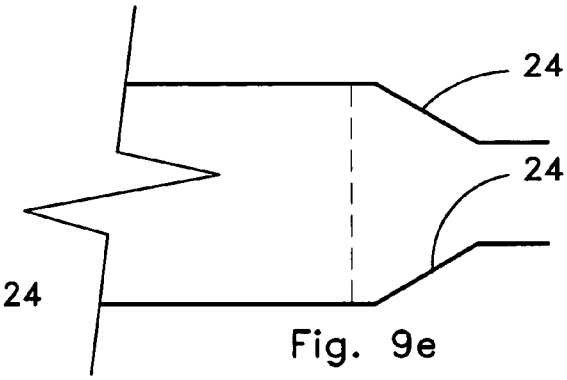
Figure 9D:
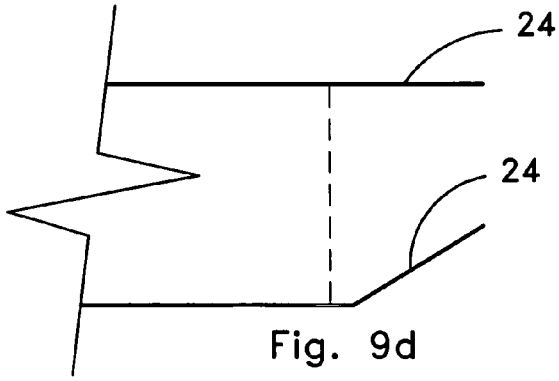

In at least one embodiment of the present invention, a vaneless diffuser 1 is applied to a centrifugal fan 2. At least one embodiment of the instant invention increases static pressure of fluid impelled by a centrifugal fan by reducing the fluid's tangential velocity 3 without the use of vanes. The radial velocity 4 may actually be kept above a certain lower limit in particularly designed diffusers in order to prevent boundary layer separation and recirculation of fluid from beyond the diffuser outlet back into the diffuser. Such recirculation typically would occur near the interior edges of the oppositely established impelled fluid directing sides of the diffuser forms (as opposed to substantially halfway between the oppositely established impelled fluid directing sides). FIG. 7 shows the results of flow modeling of an 18-inch diameter diffuser of the current invention attached to an 8-inch diameter radial discharge fan delivering 720 cubic feet per minute and operating at rotational speeds of 3500, 2000, and 1000 revolutions per minute. The same fan operating at 2000 revolutions per minute but with a 24-inch diameter diffuser is shown as the "2000,24" line. A 2-inch high fan with an 18-inch diffuser and operating at 5,250 revolutions per minute is shown as the "5250,2,18" line. The graph shows that the maximum regain efficiency (defined below) in converting fluid velocity pressure to static pressure occurs at various ratios of outlet area to inlet area. In this case, a uniform spacing between the opposing interior sides or surfaces of the diffuser would produce an area ratio of 2.25, and such area ratio clearly does not produce a maximum efficiency for any fan speed. However, the use of a diffuser in accordance with at least one embodiment of the present invention effects a significant increase in regain efficiency as compared with the case of parallel plates (a known diffuser type which, in the instant case, would have an area ratio of 2.25), as indicated by FIG. 7. It should be noted that for outlet areas that are too small, the increase in radial velocity offsets the decrease in tangential velocity and reduces overall regain efficiency. At outlet areas that are too large, flow separation and backflow 5 occurs, also reducing regain efficiency.

Regain efficiency is but one index of how well a diffuser is performing. Other indices include regain effectiveness and, when the powering motor is considered in conjunction with the diffuser, mechanical efficiency. Regain efficiency is the percentage of the change in fluid velocity pressure along the radial length of the diffuser that is transformed into (or is converted to) static pressure. It is a classic measure of diffuser performance. It may be relatively insensitive to diffuser radial size (including ratio of the outer diffuser radius to the inner diffuser radius) because as larger diffusers are used, the change in velocity pressure will increase, but so will the amount of that change that is converted to static pressure if proper adjustments such as axial convergence to the contour of the inner diffuser walls are made. It should be noted, however, that at some point of increasing convergence of the diffuser forms, viscous losses will begin to dominate. Regain efficiency may also be relatively insensitive to the relative magnitudes of radial and tangential velocities at the diffuser inlet 7.

Of course, regain efficiency does not reveal the magnitude of either the change in the velocity pressure or the resultant change in the static pressure. For an indication of the amount of velocity pressure at the inlet of the diffuser that is converted to static pressure, the regain effectiveness may be helpful. It is the percentage of inlet velocity pressure that is converted to static pressure. It should be noted that if the flow at the inlet to the diffuser has a high radial velocity relative to tangential velocity (e.g., there is not much swirl velocity, as in fan having sufficiently backward curved blades), then the regain effectiveness may be relatively low using at least one embodiment of the inventive diffuser, but the regain efficiency for this embodiment(s) might be quite high.

Figure 10:
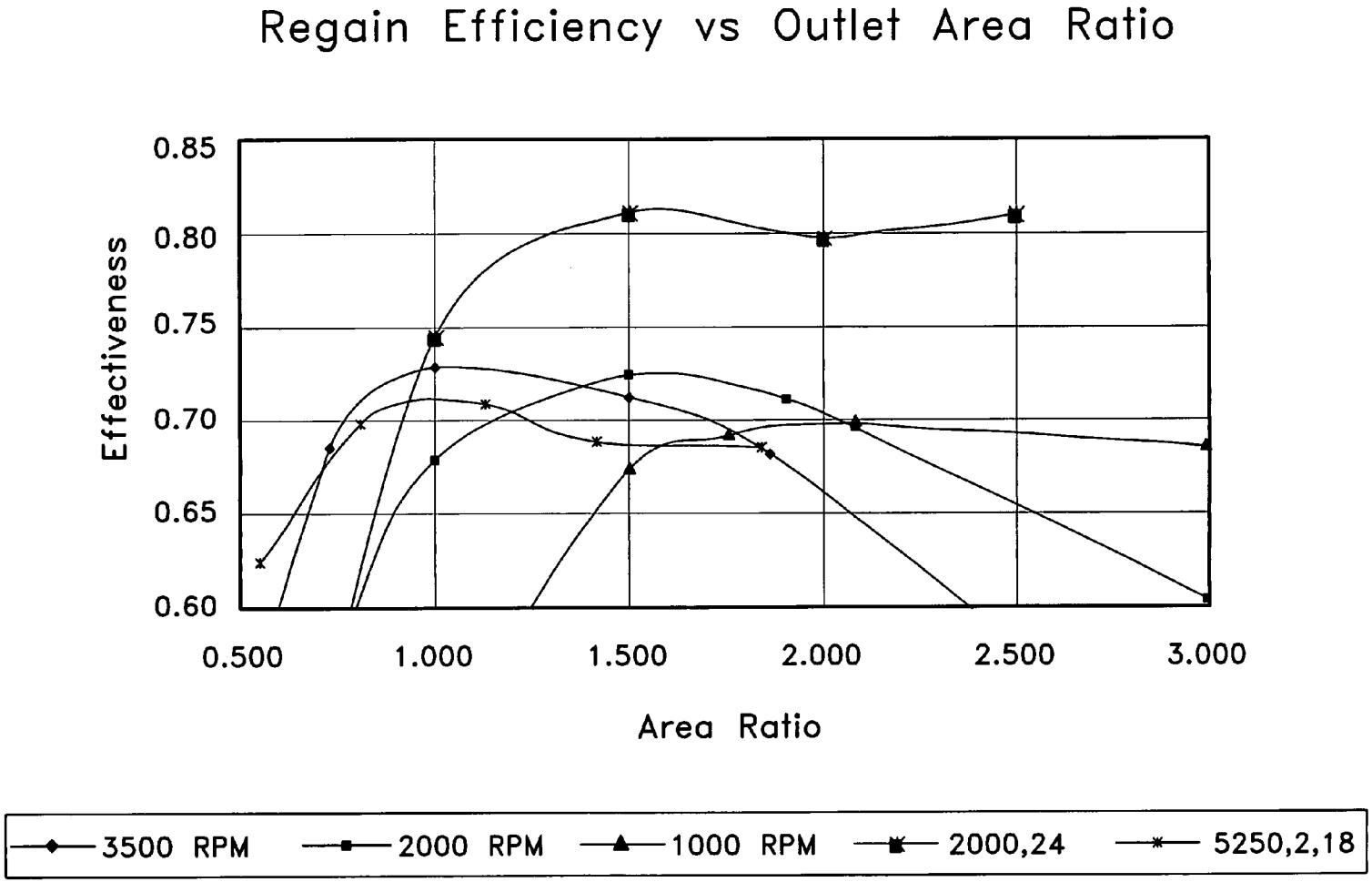
FIGS. 10(*a*)-(*d*) are non-symmetric, while FIG. 10(*e*) shows a diffuser that does not converge along its entire radial length.
Figure 11:
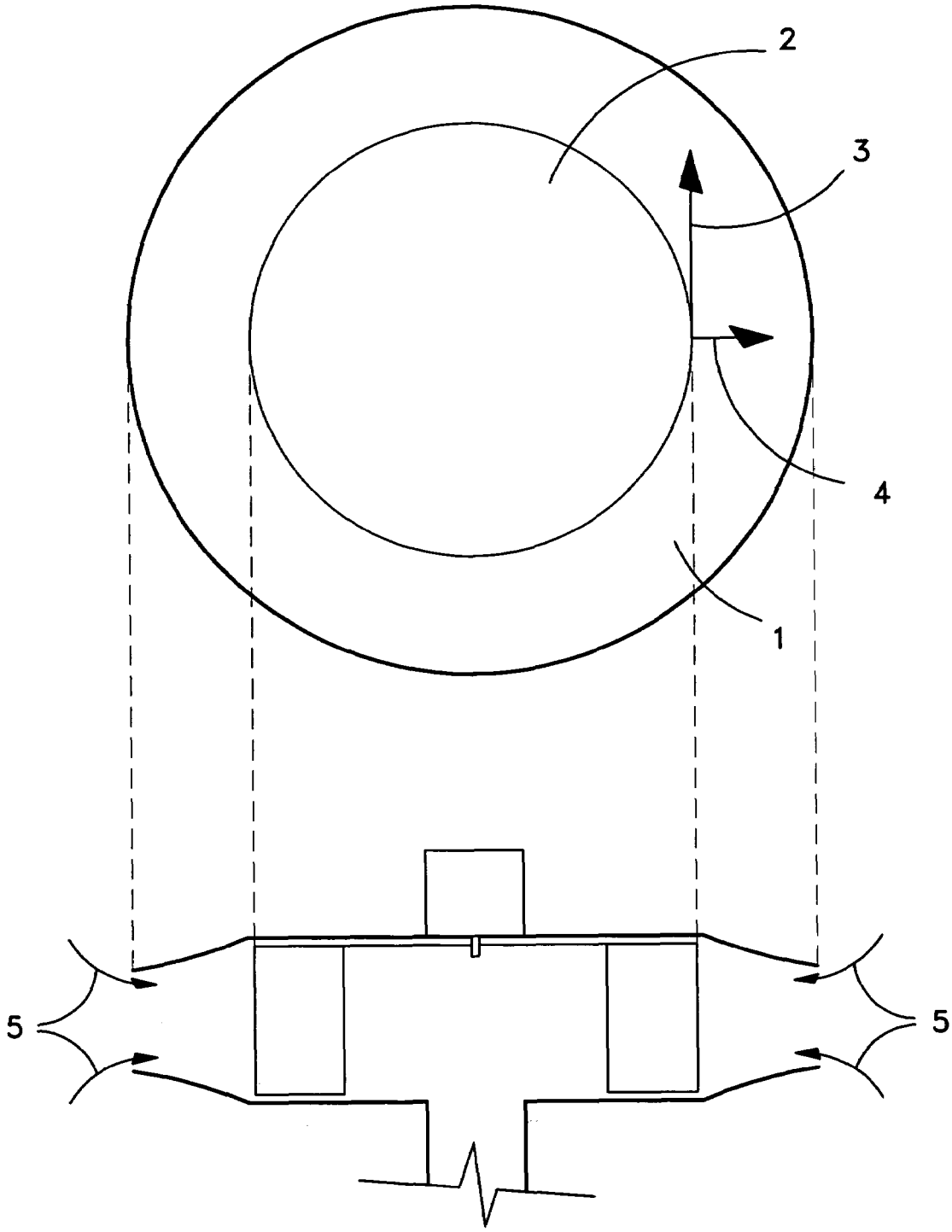
FIG. 11 shows a plan cut-away view and a side cross-sectional view of an embodiment of the inventive diffuser as used with a centrifugal fan.
Figure 12:
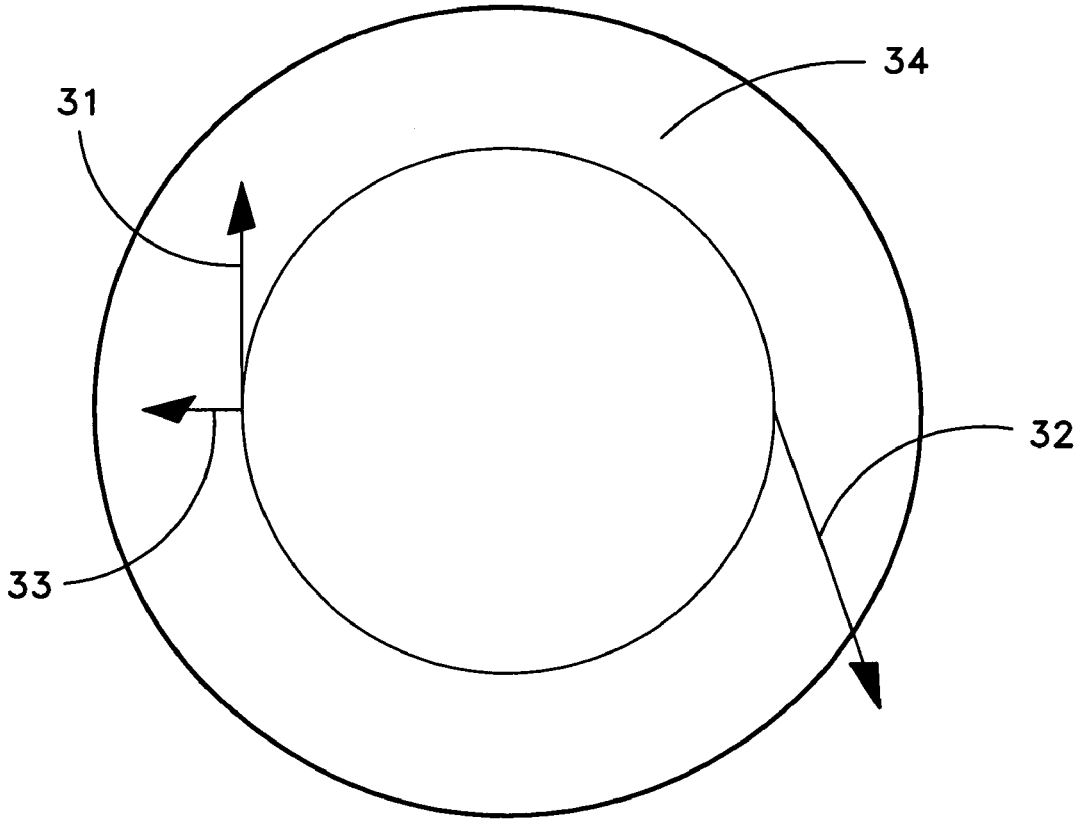
FIG. 12 shows a plan cut-away view of an embodiment of the inventive diffuser.
Figure 13:
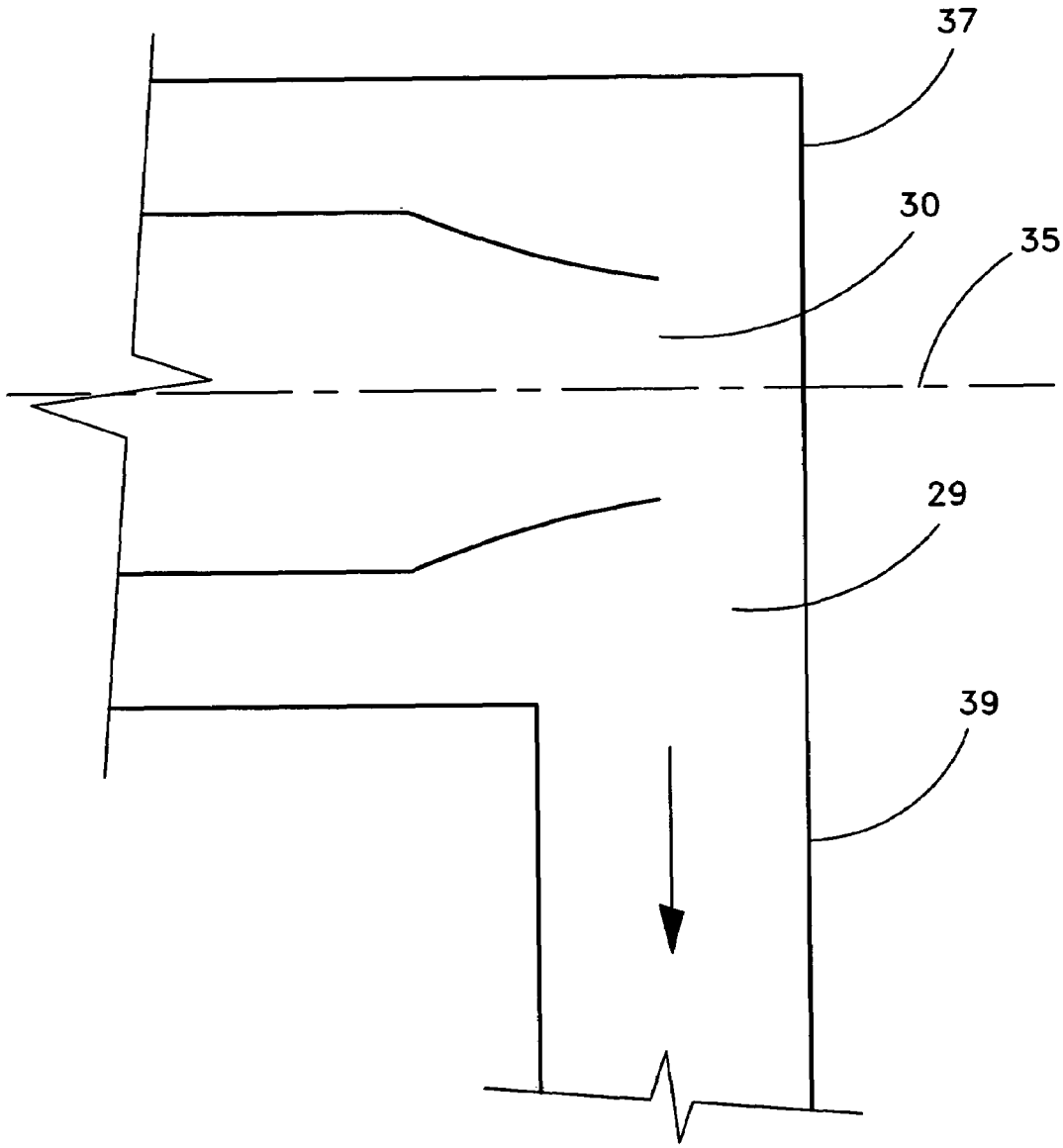
FIG. 13 shows a side cross-sectional view of a part of an embodiment of the inventive diffuser as used in a plenum leading to ductwork.
Figure 14:
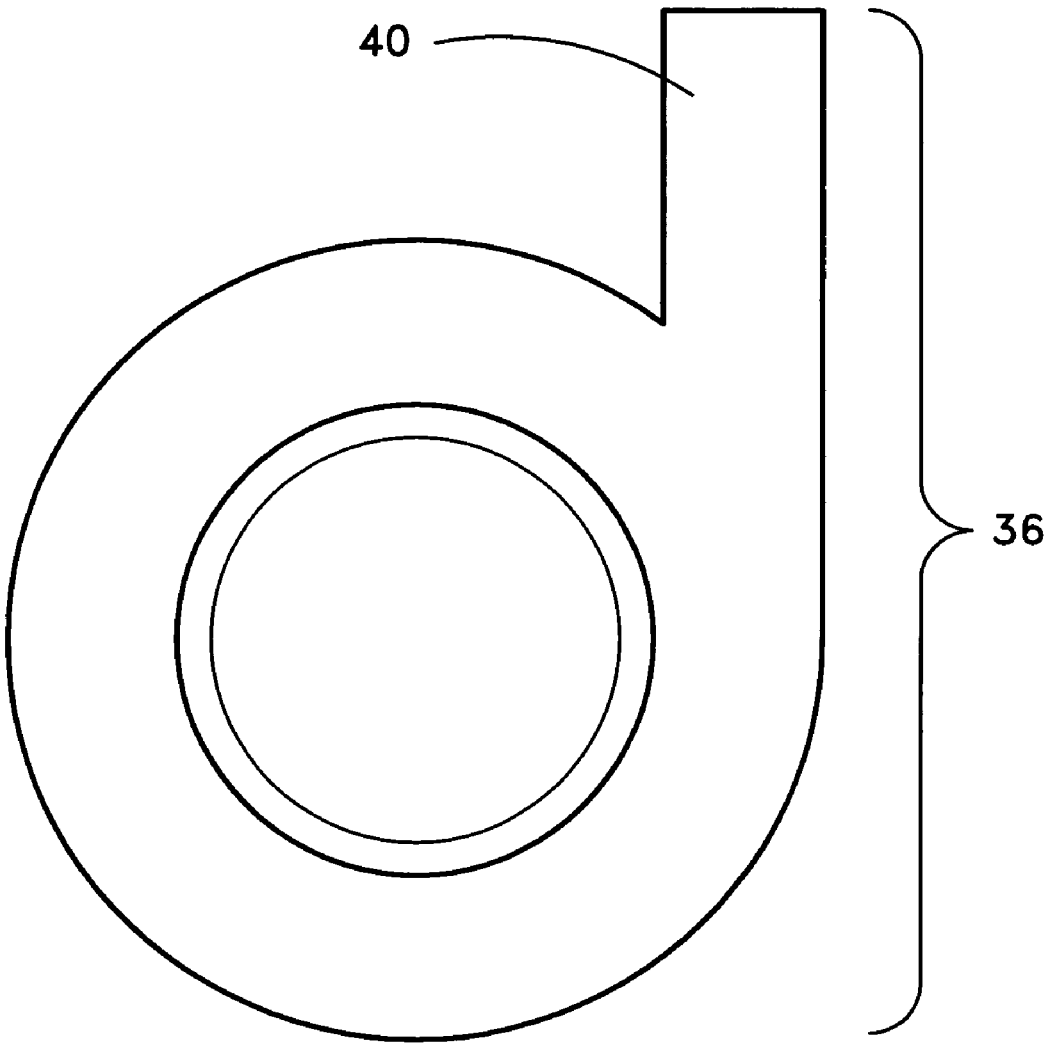
FIG. 14 shows a plan cross-sectional view of an embodiment of the inventive diffuser as used in conjunction with a scroll collector.
Figure 15:
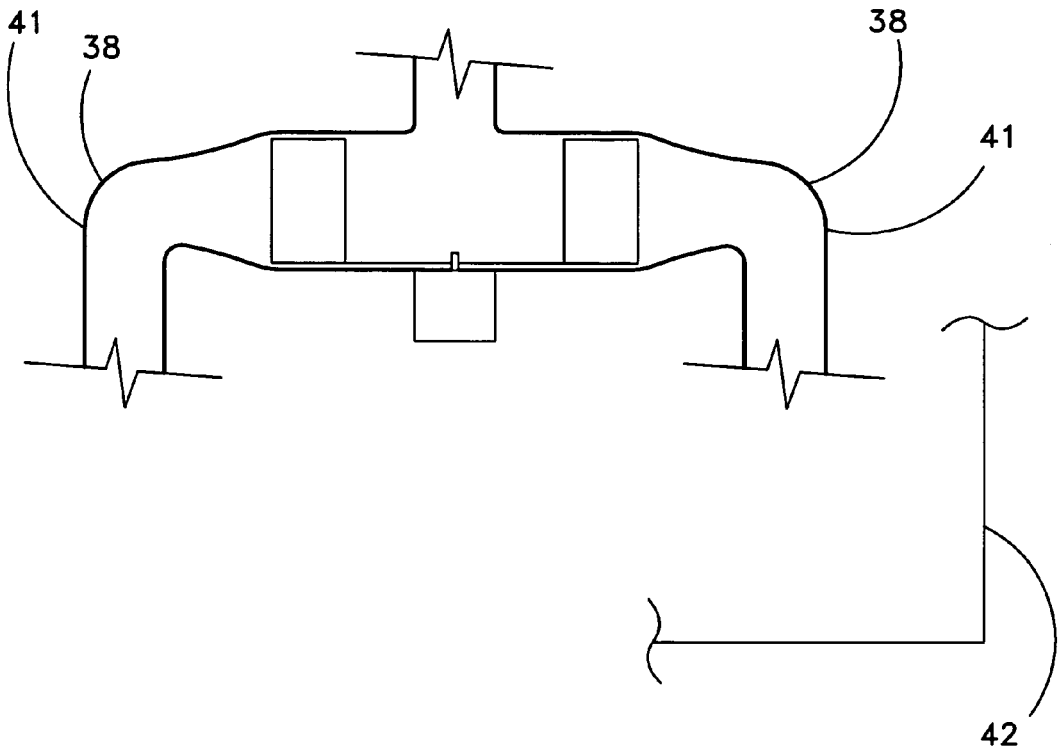
FIG. 15 shows a side cross-sectional view of an embodiment of the inventive diffuser as used in conjunction with a flow turning element.
Figure 16:
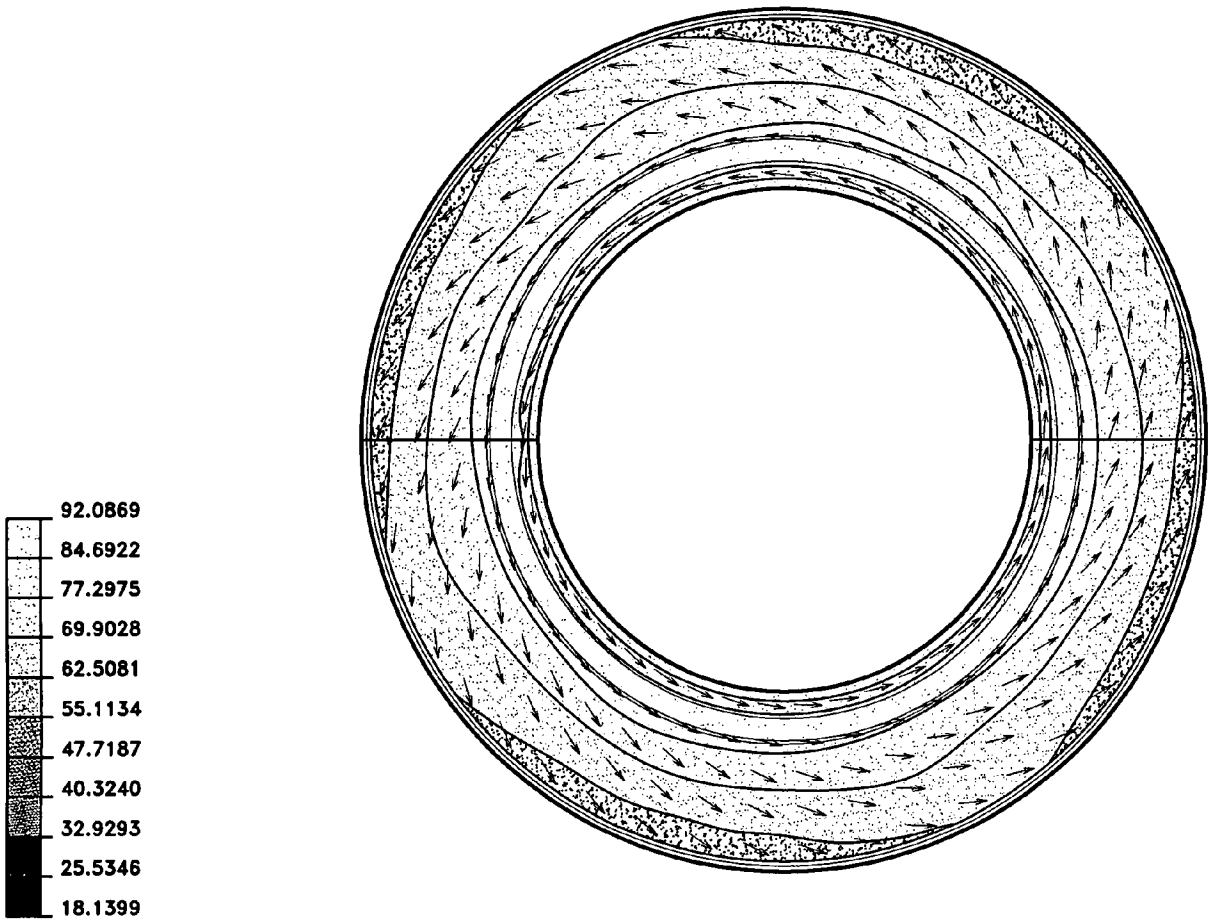
FIG. 16 shows flow velocities through an embodiment of the inventive diffuser during operation of a centrifugal fan to which it is attached; the flow velocities are presented in plan view and are predicted by computer modeling. Velocities near the inlet of the diffuser are greater in magnitude than those near the outlet of the diffuser.
Figure 17:
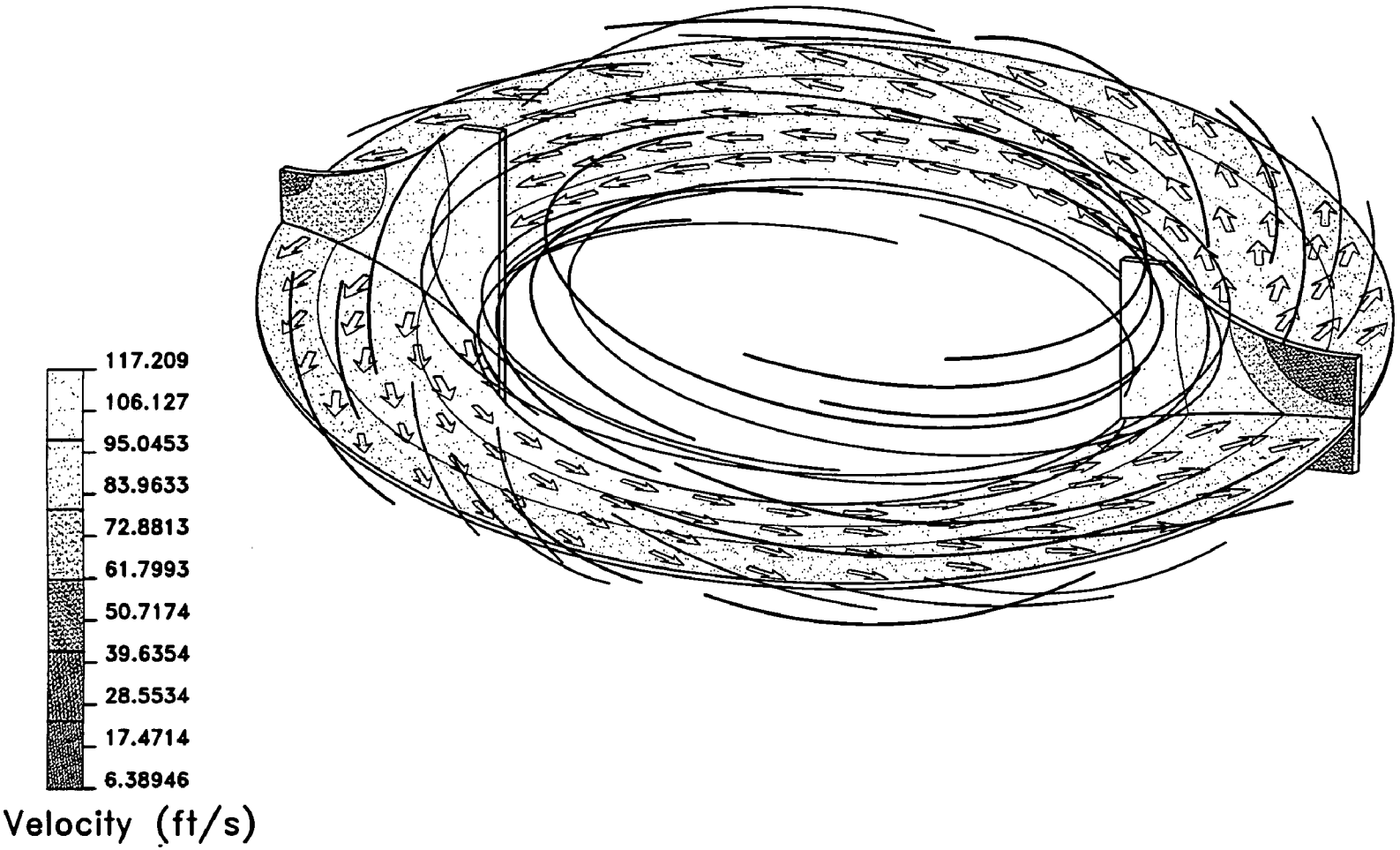
FIG. 17 shows flow velocities through an embodiment of the inventive diffuser during operation of a centrifugal fan to which it is attached, for a certain set of parameters; the flow velocities are presented in perspective view and are predicted by computer modeling. Velocities near the inlet of the diffuser are greater in magnitude than those near the outlet of the diffuser, as are velocities nearer the plane equidistant from the opposing diffuser forms. It can be appreciated from this graph that, for this embodiment, recirculation would likely first occur near the outer edge of the diffuser forms (as opposed to between the diffuser forms at their outer edges).
Figure 18:
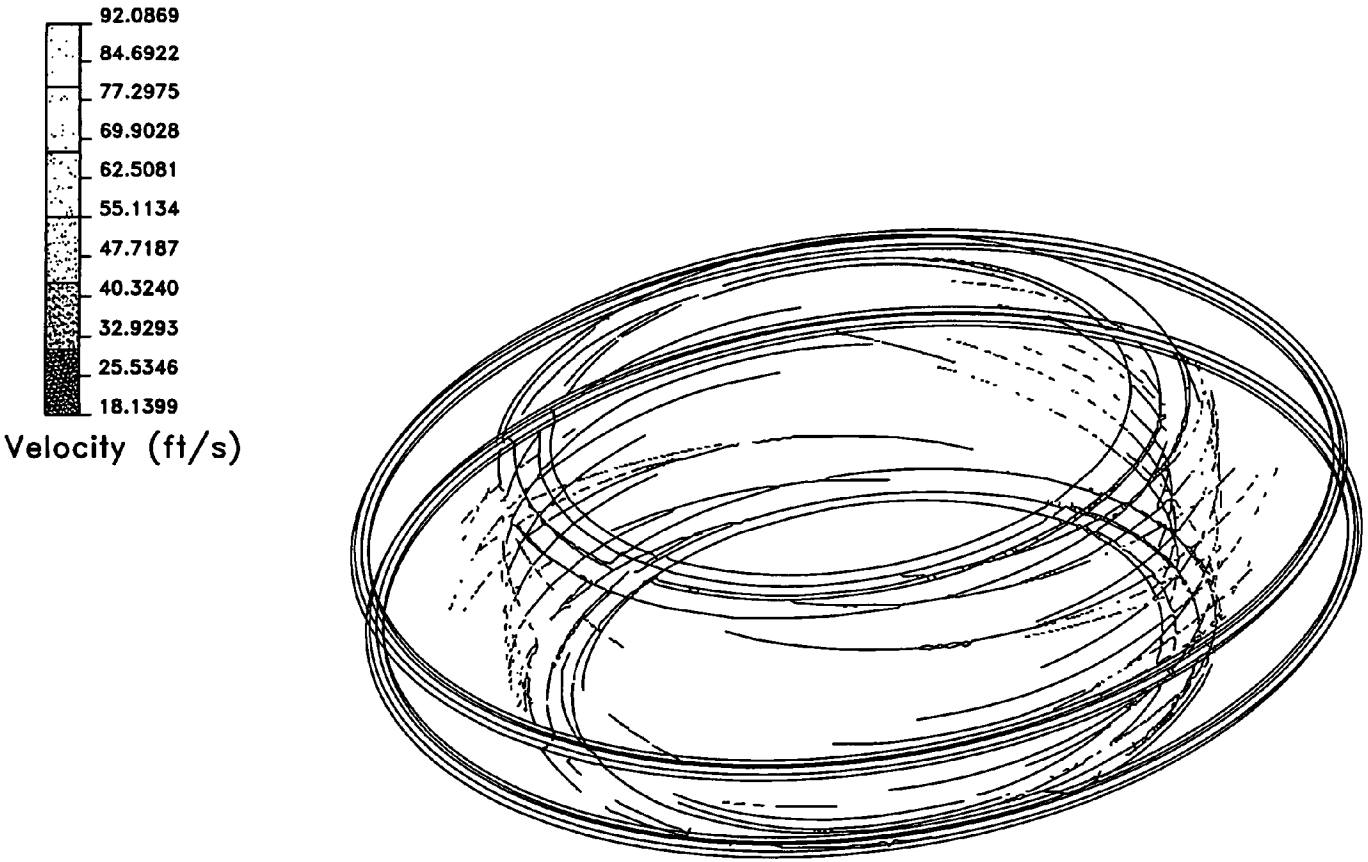
FIG. 18 shows an alternative "perspective view" depiction of speeds through an embodiment of the inventive diffuser for a certain set of parameters.
Figure 19:
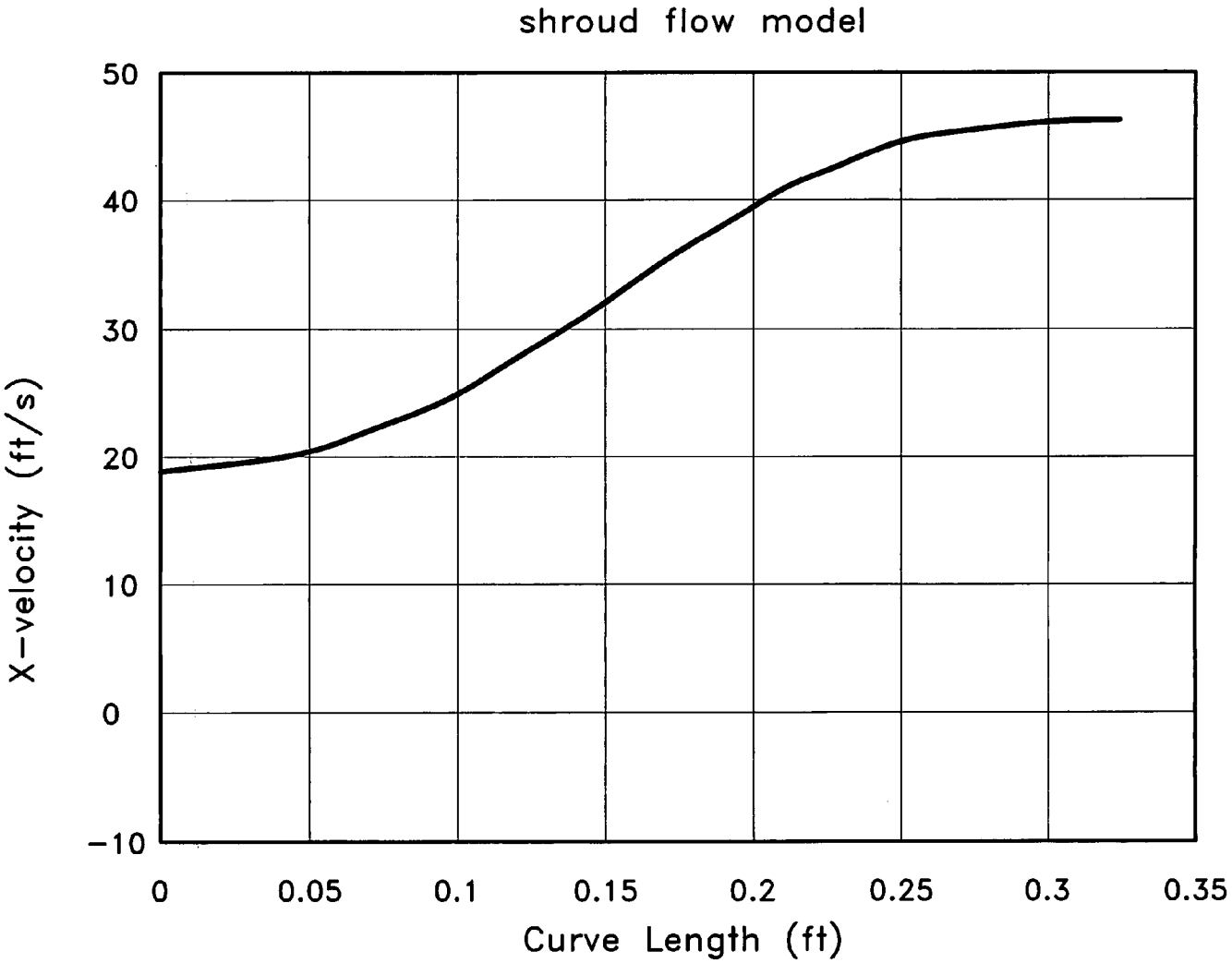
FIG. 19 shows a graph of radial speed through an embodiment of the diffuser vs. radial length of the diffuser for a specific set of fan parameters.
Figure 20:
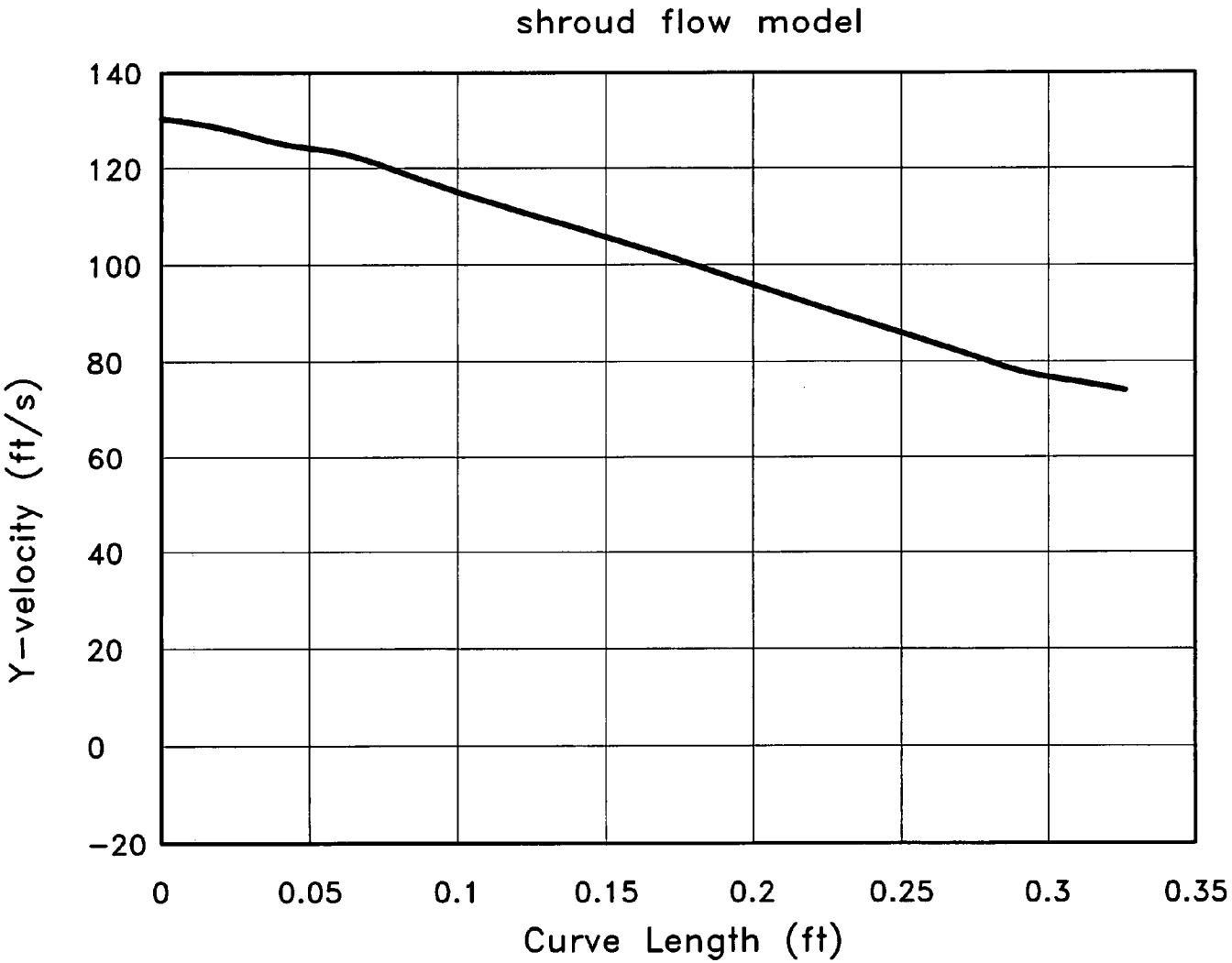
FIG. 20 shows a graph of tangential speed through an embodiment of the diffuser vs. radial length of the diffuser for a specific set of fan parameters.
Figure 21:
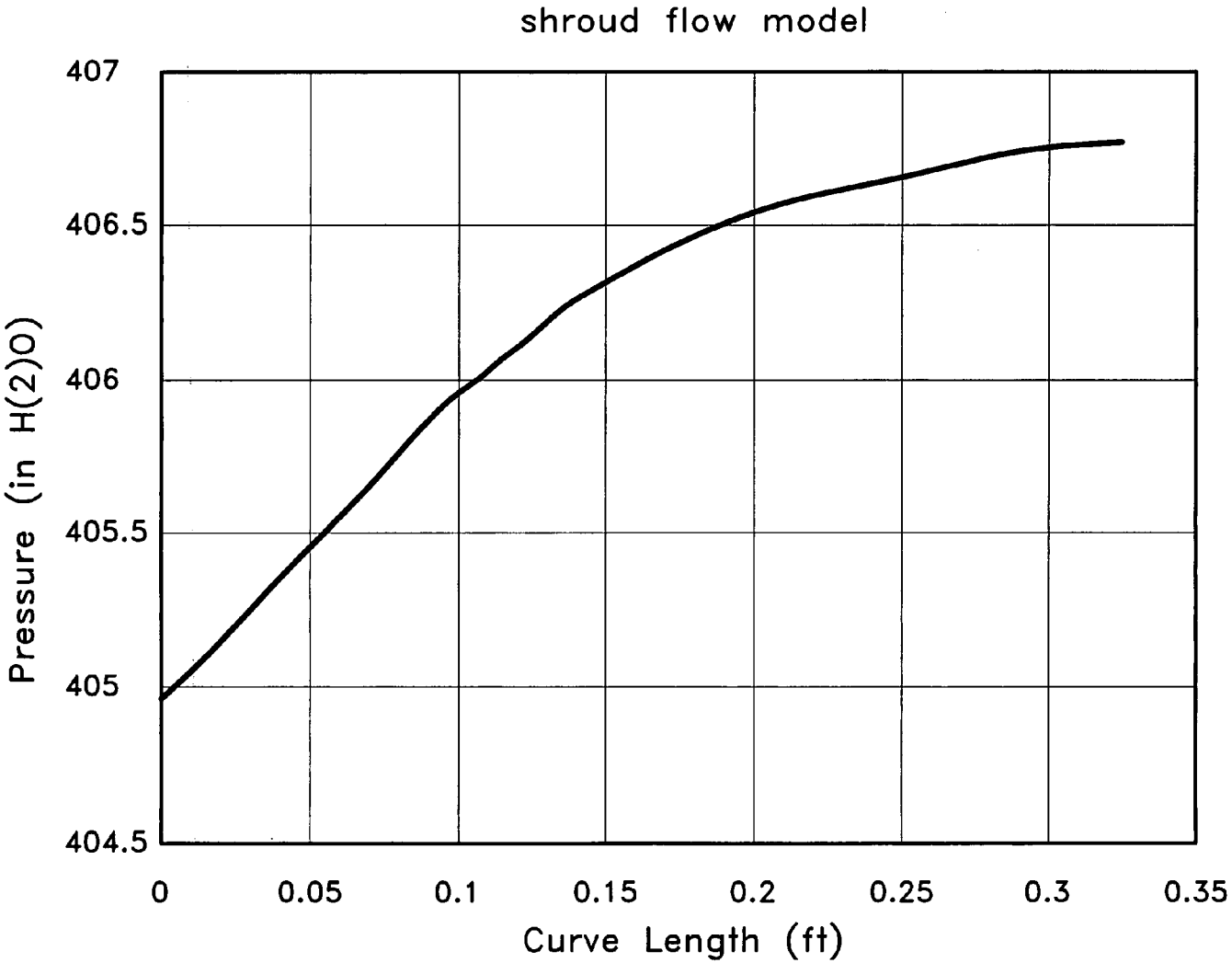
FIG. 21 shows a graph of pressure in an embodiment of the diffuser vs. radial length of the diffuser for a specific set of fan parameters.

It should be noted that the graphs of FIG. 7 and FIG. 10 show different aspects of the optimization of increasing static pressure. The recovery (or regain) efficiency graph (FIG. 7) shows the effect of modifying the radial velocity to deal with the potential for back flow. The regain effectiveness graph (FIG. 10) shows that the peak performance of the diffuser depends on the fan characteristics.

In at least one embodiment of the inventive technology, the proper measure of diffuser performance is regain efficiency. In this embodiment(s), the efficiency is maximized when the ratio of diffuser inlet area to diffuser outlet area is 1.0-1.1. It should also be noted that if the diffuser area ratio (ratio of diffuser outlet area 8 to diffuser inlet area 9) is improper—e.g., for a given diffuser application, if the diffuser outlet area is too small and unacceptable high viscous losses are realized (and/or the increase in radial velocity is significantly more than is necessary to prevent recirculation 5), or if the diffuser outlet area is too large and recirculation losses are realized—then the regain efficiency will reflect this. The optimal regain efficiency is found to exist between that lower diffuser area ratio at and below which viscous losses are unacceptably high (and/or the increase in radial velocity is significantly more than is necessary to prevent recirculation) and that upper diffuser area ratio at and above which losses attributable to flow recirculation are unacceptably high. This optimal regain efficiency occurs at an optimal diffuser area ratio. The optimal regain efficiency may include not only the maximum regain efficiencies, but also those efficiencies that are 95% or higher of the maximum regain efficiency. The optimal diffuser area ratio would be those area ratios that result in a regain efficiency that is in this optimal range (an optimal regain efficiency).

Although the performance of any centrifugal fan may be improved upon the coupling of the fan "as is" with the inventive diffuser (e.g., by "retrofitting"), at least one embodiment of the invention may involve a centrifugal fan that is adapted for use with the inventive diffuser (which may be referred to as a shroud) through specific design. In doing so, the performance of the fan as specifically designed and in conjunction with the inventive diffuser may be better than the performance of that centrifugal fan in an unadapted condition in conjunction with the inventive diffuser. Such an adapted fan may be specifically designed or even optimized with respect to blade outlet angle, rotational speed, and wheel width. Such specifically designed fan may also reflect other features that are intended to enhance the fan's compatibility with the inventive diffuser and/or increase the performance and efficiency of the fan when used with the inventive diffuser. Such specifically designed fan may, e.g., have forwardly curved impeller blades and, at least as compared with conventional centrifugal fans with backwardly curved blades and no extra-radial diffuser, may thereby effect a "relocation" of the site of fluid diffusion (e.g., a relocation by radial extension), and thus a preclusion of the instability problems attributable to backwardly curved blades of some conventional prior art centrifugal fans. It is important to note, however, that a fan not having such backwardly curved fan blades typically need not be specifically designed for use with the inventive diffuser in order to realize sufficient operational improvements (although indeed it may be so designed).

Figure 1:
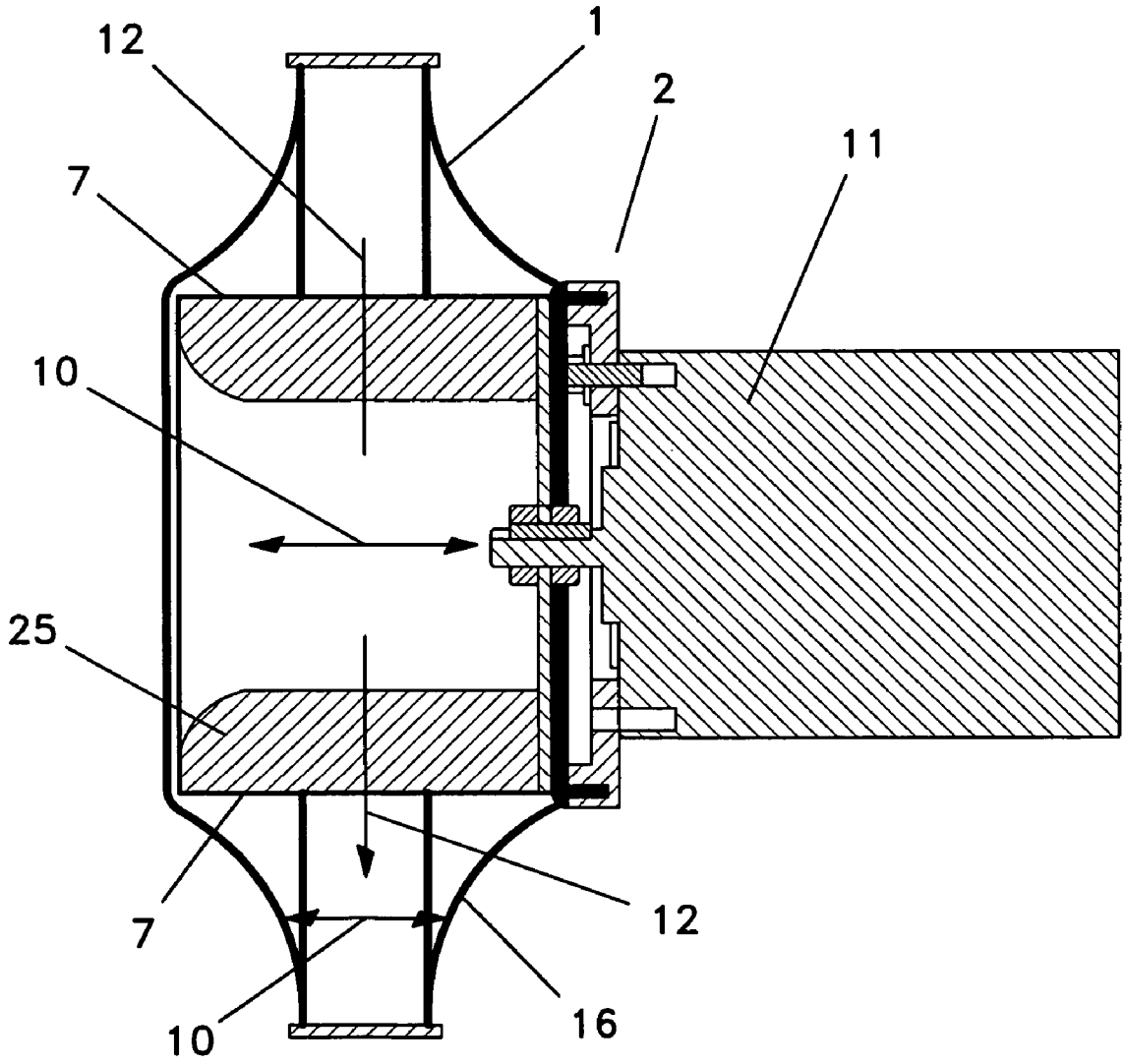
FIG. 1 shows a cross-sectional view of at least one embodiment of the inventive diffuser as incorporated with a centrifugal fan.

FIG. 1 shows some general features of at least one embodiment of the invention applied to a centrifugal fan. It is important to note that in a preferred embodiment, the inventive diffuser is used to increase the efficiency of a centrifugal fan that does not impel fluid in the axial direction 10. FIG. 1 shows a centrifugal fan which accepts fluid through an opening on the left of the figure. The fan is rotated by motor 11. This impels the fluid flow to turn from an axial direction (referring to the fan's axis of rotation) to a generally radial direction 12 (referring to that radial direction defined by the fan's rotation) and pass through the structure of the fan. In doing so the static pressure of the fluid increases and the radial (perpendicular to the axis of rotation) and tangential (tangent to the circle swept by the rotating fan wheel) velocities are changed according to the design of the fan. In a preferred embodiment of the present inventive technology, the fluid leaving the fan passes between the axially spaced walls of the inventive diffuser. In a preferred embodiment, the walls of the diffuser are stationary with respect to the motor and the fan structure. The radial velocity changes, at least in part, according to the axial spacing between the walls (e.g., the axial length of the diffuser outlet relative to that length of the diffuser inlet) and may be merely kept above a certain amount or even increased as necessary to prevent recirculation of pressurized fluid back into the diffuser. The tangential velocity of fluid passing through the inventive diffuser decreases with increasing radial distance from the fan according to the conservation of fluid angular momentum. Of course, angular momentum of the fluid is conserved (or at least substantially so) because as impelled fluid travels from diffuser inlet to diffuser outlet, appreciable energy is neither added to nor taken from the fluid (ignoring relatively small losses of energy attributable to friction). This approach is entirely different from that of conventional diffusers (e.g., that diffuser described in U.S. Pat. No. 4,323,330, or parallel plate diffusers as described in Tsurusaki, pp. 279-287, supra).

Figure 6:
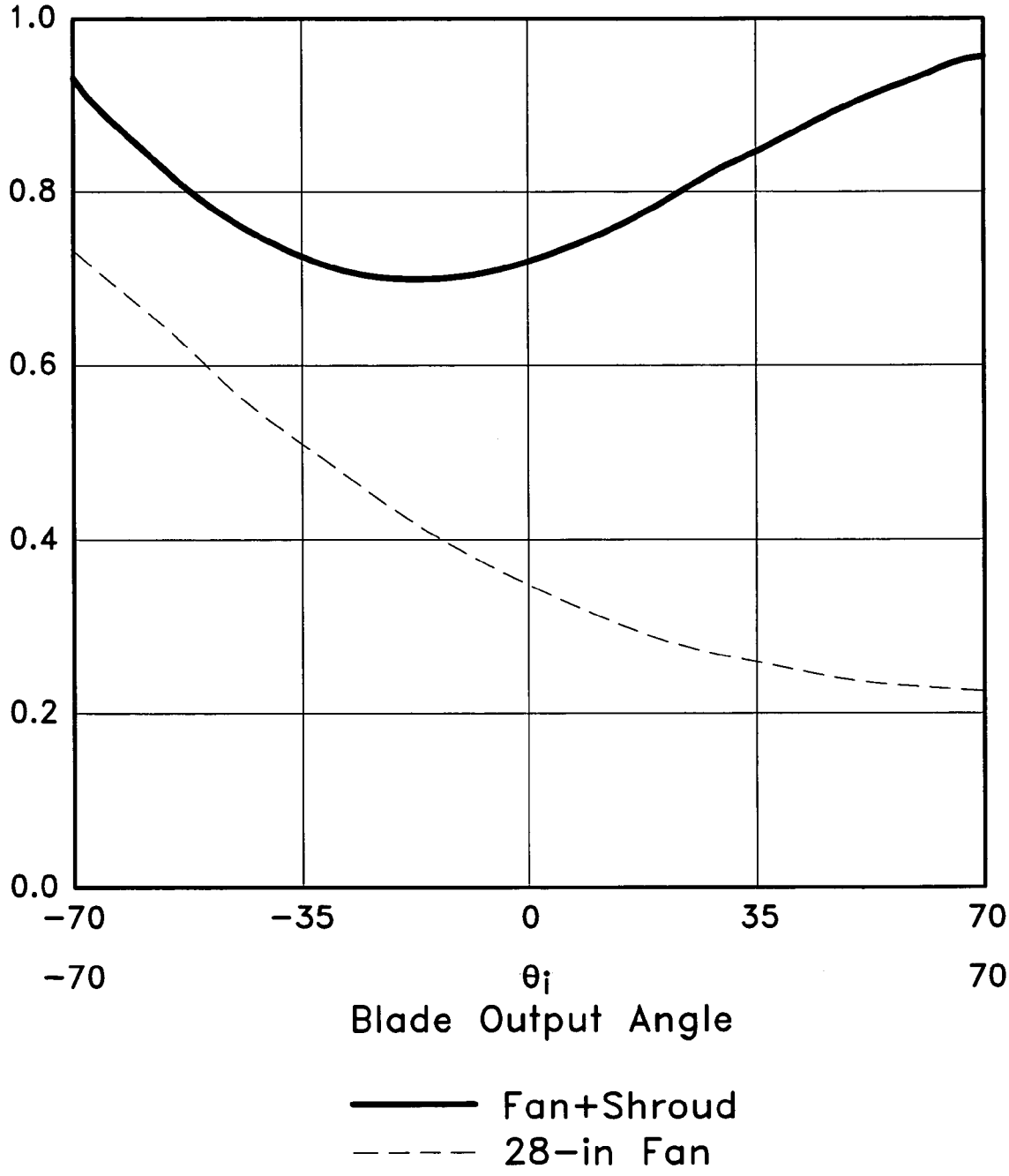
FIG. 6 shows computed ideal static pressure efficiencies of a centrifugal fan and inventive diffuser system for different impeller blade outlet angles as compared with computed ideal static pressure efficiencies of a centrifugal fan without the inventive diffuser for these different impeller blade outlet angles, each for the same specific fan parameters. Static pressure efficiency of a fan is the ratio of fan output (e.g., flow x static pressure) to input power (e.g., shaft power input to the fan).

The graph of FIG. 6 shows, for a specific set of fan and diffuser parameters (e.g., fan diameter and rotation speed), computed ideal static pressure efficiencies of a fan and a vaneless diffuser with which it is properly matched as compared with a conventional unhoused centrifugal fan (i.e., one without the inventive diffuser disclosed herein and without a scroll). Static efficiency is the fraction of total pressure recovered as static pressure; with a hypothetically 100% statically efficient fan, all the work input to the fan appears as static pressure. It can be seen that the inventive diffuser has the effect of increasing the output static efficiency compared to the fan without the diffuser. Forward curved fans (positive blade angles) show the greatest improvement. Backward curved fans (negative angles) show less, but still significant improvement. The exact percentage of pressure recovered is a function (at least in part) of fan rotational speed, blade angle, fan diameter, diffuser diameter, diffuser inlet and outlet opening, and diffuser wall shape(s). As can be seen, the overall performance of the fan-diffuser unit is, in part, a function of outlet fan blade angle. In addition, the performance of a small, relatively inexpensive forward curved fan (positive discharge angle in the graph) can be better than the best backward curved airfoil fan (the largest negative angle in the graph). Other combinations of blade angle, fan diameter, and rotational speed will of course produce different performance. However, in general, the trend is for the diffuser to permit forward curved fans in conjunction with the present inventive diffuser to produce static pressure efficiencies greater than those found in the best backward curved airfoil fans. This allows the use of the less expensive forward curved fan impellers to achieve high efficiency. Ideal application of the diffuser may also include matching the discharge velocity characteristics of the fan to the diffuser. It is therefore possible to achieve the efficiency of a relatively expensive backward inclined fan with a smaller, less-expensive forward curved fan operating in a properly designed vaneless diffuser.

The graph of FIG. 7 shows that an optimum diffuser is possible by carefully balancing the degree of radial velocity diffusion against the degree of tangential velocity diffusion. Diffuser outlet area ratios of 1 or less are typically less than optimal because the radial velocity is higher than necessary at the outlet (and thus, a possible increase in static pressure is realized instead as an increase in velocity pressure). Diffuser outlet area ratios of greater than 2.5 are typically less than optimal because such outlet area ratios cause boundary layer separation and radial backflow (recirculation) problems begin to develop.

Impelled air output from the diffuser to the downflow fluid handling environment (e.g., a scroll, a plenum, ductwork, and/or a flow turning element, as but a few examples) may have a zero net tangential velocity (as where, e.g., upon consideration of the tangential velocity of all flow output from the diffuser, for every streamline in one tangential direction there is a streamline in a substantially opposite tangential direction). Impelled air output to the downflow fluid handling environment may have a zero net velocity where, e.g., upon consideration of the velocity of all flow output from the diffuser, for every streamline in one direction there is a streamline in a substantially opposite direction. A zero net velocity may be observed when the impelled fluid directing forms are "mirror-image" symmetric about a "radial plane" that bisects the sides.

In one design it can be seen that the inventive diffuser's flow path may be sufficiently narrow to offer an opportunity to eliminate noise without the additional pressure loss attributable to conventional placement of acoustical equipment. In at least one embodiment, noise reduction may be accomplished by adding acoustically absorbing material or acoustical material to the outside 13 of the diffuser walls 14. The acoustically absorbing material could be contained behind or external of diffuser walls (or the diffuser element or diffuser forms) that are perforated in a preferred embodiment; in a preferred embodiment, the material is placed in a space formed by a converging embodiment of the diffuser. The diffuser element or the diffuser forms could themselves be made from (in whole or in sufficient part) acoustical material.

Figure 2:
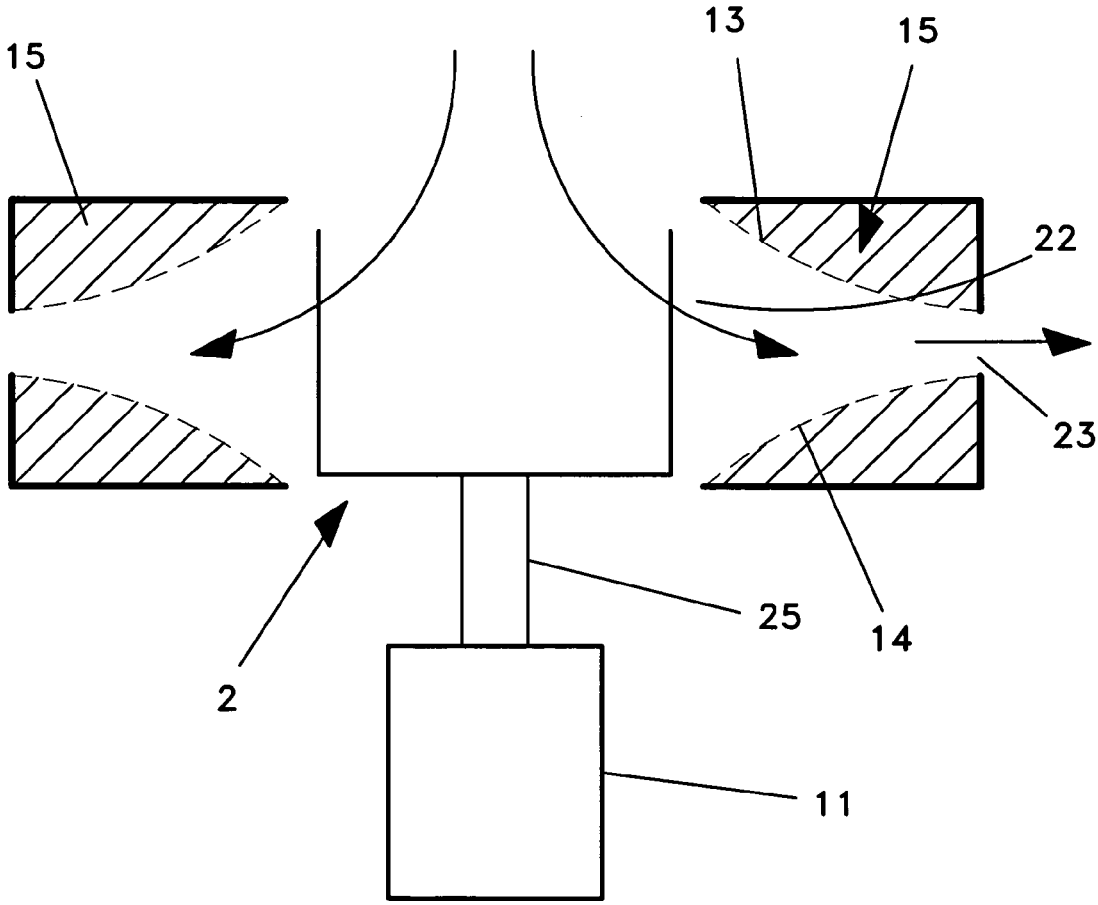
FIG. 2 shows another cross-sectional view of at least one embodiment of the inventive diffuser as incorporated with a centrifugal fan and as acoustically treated, in addition to fluid flow directions.
Figure 4:
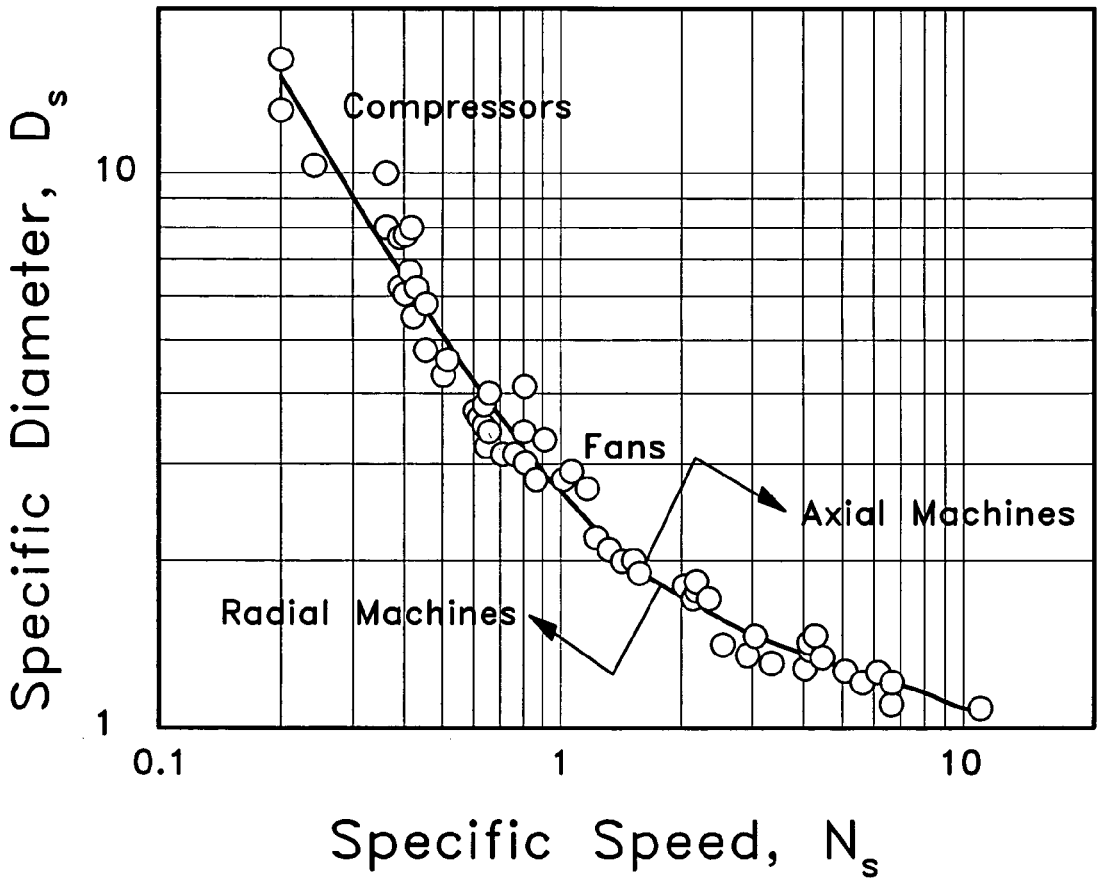
FIG. 4 shows a Cordier graph relating specific diameter to specific speed for compressors as compared with fans, and for axial machines as compared with radial machines.
Figure 5:
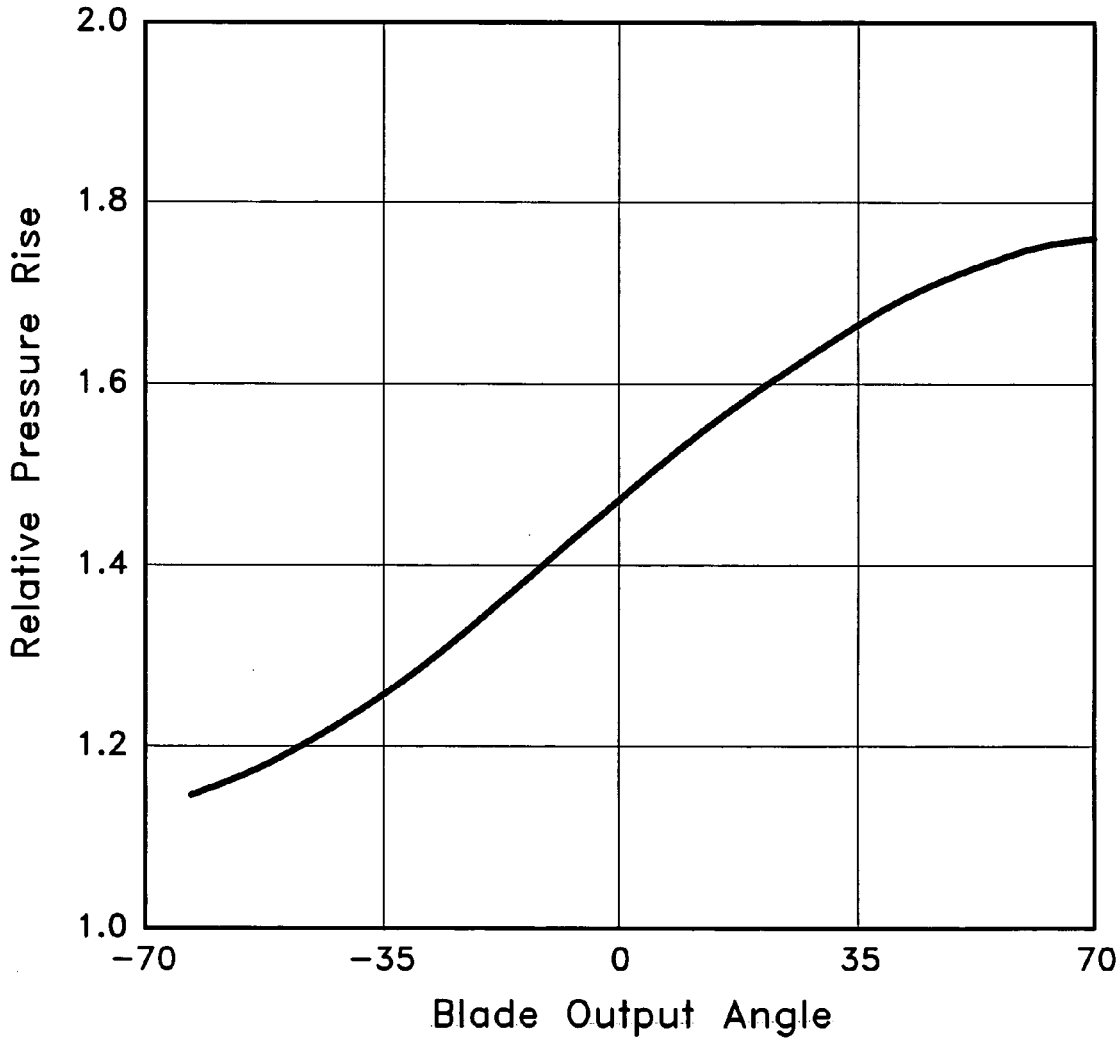
FIG. 5 shows a graph of relative pressure rise for a centrifugal fan without a diffuser vs. blade outlet angle.

Of course, the term diffuser element includes within its breadth (but is not limited to) perforated diffuser elements and non-perforated diffuser elements, and the term diffuser form includes within its breadth (but is not limited to) perforated diffuser forms and non-perforated diffuser forms. Instead of (or in addition to) establishing acoustical material outside the diffuser element (or the diffuser forms), the diffuser element (or the diffuser forms) could be acoustical material itself (or themselves). Indeed, the term diffuser element includes within its breadth diffuser elements made from any material, including acoustical material (e.g., fiberglass with appropriate containment, porous fibrous polyester, open-cell polyurethane or melamine foam). Similarly, the term diffuser form includes within its breadth diffuser elements made from any material, including acoustical material. One design is shown in FIG. 2, where fan motor drives a centrifugal fan with a diffuser including acoustical material, absorber or treatment 15 adjacent to and external of the walls of diffuser.

At least one embodiment of the invention seeks to increase the amount of static pressure of a fluid impelled by a centrifugal fan by exploiting the principle of conservation of angular momentum. In a preferred embodiment of the invention, the majority (including more than 50%, more than 70%, more than 80%, more than 90%, and more than 95%) of the total increase in static pressure observed as fluid (e.g., air) impelled by and discharged from the centrifugal fan travels through the diffuser element is attributable to a decrease in the tangential velocity of the fluid discharged from the centrifugal fan to the inventive diffuser. Simply, no prior art obtains such an increase in static pressure from a decrease in tangential velocity pressure to the degree made possible by at least one embodiment of the present invention. This increase is a result of the transformation of the tangential velocity (or dynamic) pressure of the discharged fluid to static pressure. More particularly, the transformation may be effected upon a radial extension (radial defined as perpendicular to the axis of rotation of the centrifugal fan) of the interface through which air is output from the diffuser to a downflow fluid handling environment.

Importantly, impelled fluid traveling through the diffuser is a substantially closed energy system (i.e., no appreciable addition of energy or deletions of energy to the fluid from entry into the diffuser to exit from the diffuser (either ignoring frictional losses or because such losses are relatively minor)). Therefore, fluid flow through the diffuser may be physically modeled (at least approximately) according to the principle of the conservation of angular momentum, and a radially outward extension of the rotating impelled fluid while it is in the diffuser results in a decrease of the tangential velocity (and the tangential velocity pressure) of that fluid. Conservation of energy demands that while the fluid is in the substantially closed system of the diffuser, a decrease in the tangential pressure will result in an increase in the static pressure of the fluid. As indicated, the decrease in the tangential velocity of the fluid may be achieved by efficiently directing the fluid to an increased distance (as compared with the outer radial distance limit of the diffuser inlet) from the centerline or axis of rotation of the fan. As air leaving centrifugal fans often has a relatively high tangential velocity, reduction of the tangential velocity as based on conservation of angular momentum principles may result in a significant increase in static pressure through conservation of energy principles. For example, a diffuser on a forward curved fan could double the static pressure output of the fan/diffuser combination. A diffuser on a backward curved fan might increase the static pressure output by 20% as shown in the example curve of FIG. 6.

An advantage of the vaneless design of at least one embodiment of the inventive diffuser is a relative insensitivity (compared with any conventional vaned designs) to flow angle (relative to a radial axis) of the impelled fluid. Additional advantages afforded by the vaneless design are that vaned diffusers work best at one speed only, and typically result in only a 2-5% increase in efficiency, at least in part because their losses may offset the bulk of any static pressure gain. Vaneless diffusers operating on the principle of the conservation of angular momentum as in at least one embodiment of the instant invention, however, achieve significant increases in static pressure at various speeds, and also are generally unaffected by changes in the inlet flow direction.

Advantages of those embodiments in which the diffuser outlet separation (e.g., axial separation between diffuser forms at outlet) is less than the diffuser inlet separation include: (a) provision of an ability to control the radial velocity of the impelled fluid after discharge from the centrifugal fan in order to prevent unwanted recirculation of fluid back into the diffuser element; and (b) reduction in the generation of unwanted noise because of a reduction in the size of the flowpath through which impelled fluid travels, as but two examples. It should be noted that, especially where the fluid is axially converged along any portion of its radial length (converged in a direction parallel to the axis of rotation of the centrifugal fan by, e.g., "necking down" the diffuser outlet opening), the diffuser is well suited for application of acoustical material outside of the diffuser (e.g., at least partially within that space formed by converging diffuser walls). Indeed, at least one embodiment of the inventive technology may be viewed as providing a site for the placement of acoustical material, this site contiguous with the diffuser element and enabling the use of less (as compared with conventional acoustical treatment methods) acoustical material to achieve the same sound reduction. It should also be noted, however, that any effective reduction in noise may itself be reduced by an increase in noise resulting from a smaller fan (perhaps operating at higher speeds) that may be enabled by at least one embodiment of the invention.

In at least one embodiment of the invention, the impelled fluid directing side of at least one of the diffuser forms that are established substantially opposite one another traces a curved line according to the following equation:

$$\text{Axial separation (or length) at radius } r = \frac{\text{(Area Ratio)}\ \text{(Axial separation at diffuser inlet)}\ \text{(Fan Outer Radius)}}{r}$$

where r is the radius at which the axial separation is to be determined, the area ratio is the diffuser outlet area divided by diffuser inlet area, and axial separation indicates the axial distance between diffuser forms at the indicated radius. It should be understood that there are various shapes that could approximate the 1/r contour, and that the above equations represents only one embodiment of the instant inventive technology. In preferred embodiments, the walls or impelled fluid directing sides smoothly curve while they converge (e.g., they smoothly axially converge).

If, in the case of diffuser forms symmetrically established about a radial, center plane that bisects the forms, the distance from this radial, center plane can be estimated simply by dividing the axial separation in half. In at least one embodiment of the invention where the area of the diffuser outlet is substantially equal to the area of the diffuser inlet (i.e., the diffuser area ratio is approximately equal to 1), the ratio of the diffuser axial separation at the diffuser outlet to the diffuser axial separation at the diffuser inlet may be substantially equal to the ratio of the diffuser radius at the diffuser inlet to the diffuser radius at the diffuser outlet.

Radial velocity of the impelled fluid may be sufficiently controlled so that the radial velocity upon output from the diffuser (or in the vicinity thereof) is sufficiently high to prevent recirculation. Indeed, whenever the radial velocity at output from the diffuser (or in the vicinity thereof) is sufficiently high to prevent recirculation, the radial velocity of the impelled fluid may be said to be sufficiently controlled to prevent recirculation. This may be done by designing the diffuser so that its outlet axial length is smaller than its inlet axial length (e.g., through axial convergence) because such design may keep the radial speed of the impelled fluid at diffuser outlet above a certain limit (this certain limit that speed at or below which recirculation problems develop or are observed). Indeed, whenever the outlet separation (e.g., axial length or separation) of the diffuser is smaller than its inlet separation, there has been convergence (e.g., axial convergence). Convergence (including axial convergence) can take place along only a portion of the radial length of the diffuser, or it may take place along substantially the entire radial length of the diffuser. It may be continuous along a portion or continuous along the entire length. It may involve converging only one side of the diffuser toward the other side, as long as the diffuser's outlet separation (e.g., axial separation or length) is smaller than its inlet axial separation. Of course, any converging portion does not diverge. Outputting fluid from the diffuser so that its radial velocity is sufficiently high to prevent recirculation may be referred to simply as keeping the speed above a certain, critical limit at which recirculation-related problems may start. This may involve: (a) increasing the radial speed of the impelled fluid as it travels through the inventive diffuser (e.g., if necessary to prevent recirculation); or (b) merely assuring that the radial speed of the impelled fluid is above the critical limit at which recirculation-related problems initiate.

If the radial speed of the impelled fluid is insufficiently high, then, as the fluid moves into the rising pressure gradient caused by the centrifugal fan and by the reduced tangential velocity of the impelled fluid, it will not be able to "climb the pressure hill" that is opposing it, resulting in an imbalance of forces, boundary layer separation, and recirculation of pressurized fluid located outside of the diffuser outlet. As discussed in the literature (see, e.g., NACA TN 2610), the relevant parameter that governs the occurrence and degree of recirculation may be the radial rate of change of radial velocity combined with the magnitude of the rising pressure from diffuser inlet to outlet, which itself may be primarily controlled by the change in tangential velocity and the opening size. Some investigations into the cause of recirculation suggest that in order to avoid recirculation it may be necessary to avoid developing a very non-uniform radial velocity gradient with a large peak in the center and a large area of low velocity. In sum, the change in radial pressure may cause backflow if it is large enough, but if the radial velocity is sufficient (in some designs this might only require that the radial velocity be kept above a lower limit, but in others it might be necessary to increase it), there will be no backflow. Indeed, as one might intuit, there is an amount of "taper" (or "necking down" or flow convergence) that maximizes static pressure recovery; with too much taper, the radial velocity may be increased beyond that amount necessary to avoid recirculation, and the unnecessarily high radial speed of the impelled fluid may offset at least part of the static pressure increase caused by the diffuser's decrease in tangential velocity of the impelled fluid. However, of course with too little "taper" or with no taper at all, there may be insufficient radial speed to overcome the pressure hill, and boundary layer separation and undesired recirculation may result.

In at least one embodiment of the invention, the value of the critical speed of the radial component of the flow (i.e., the radial speed at which flow recirculation-related problems are first observed) is governed by the amount of static pressure rise (attributable to a decrease in tangential velocity of the impelled fluid). As explained, the greater the pressure increase, the higher the radial speed of the impelled fluid will need to be to prevent recirculation of this increased pressure fluid. Thus, it is expected that fans operating at higher speeds will necessitate (for optimal performance) a smaller diffuser area ratio (diffuser outlet area/diffuser inlet area) than will be required with fans operating at slower speeds. As observed in Graph 7, indeed, the optimal 3500 rpm fan has a smaller area ratio than the optimal 1000 rpm fan. Of course, whenever the area ratio is decreased below 1.0, the radial speed is increased by the diffuser, and, as a result, the pressure rise attributable to the diffuser decreases.

In order to properly size a diffuser for application according to one approach, the following steps may be taken.

1. Select a centrifugal fan using convention methods as based on the determined airflow volume and the static pressure required for that specific design application (if the diffuser is to be retrofit onto an existing fan, then there is of course no need to select a fan);

2. Determine the tangential and radial velocities at the discharge from the centrifugal fan using conventional techniques (velocities are a function of the speed of the fan, the specific blade configuration of the fan, and the fan dimensions);

3. Determine the maximum allowable outer radius of the inventive diffuser to be installed onto the centrifugal fan by considering design constraints (e.g., the location of a fan support structure, the plenum box structure or other downflow fluid handling environment structure, in addition perhaps to an allowance for spacing between the inside of this structure (e.g., the plenum box) and the most radially distant edge of the diffuser forms). Consideration may also be given to the fact that the incremental increase in static pressure effected by the incremental increase in the radial "reach" of the outer edge of the diffuser becomes very small beyond a certain radial "reach" of the diffuser's outer edge. As such, this rate of diminished returns advises against spending money on diffuser size beyond a certain size. It should also be noted that the fan support frame may be adjusted and resized as necessary.

$$P_{INCREASE} = \frac{Rho}{2}\eta\left[V_{RADIAL}^2\left(1-\left(\frac{1}{AR}\right)^2\right)+V_{TANGE}^2\left(1-\left(\frac{1}{RR}\right)^2\right)\right]$$

Where:

$RR$ = Diffuser Radius Ratio $Rho$ = Fluid Density $AR$ = Area Ratio = $\frac{\text{Diffuser Outlet Area}}{\text{Diffuser Inlet Area}}$ $\eta$ = Regain Efficiency 4. Determine the centrifugal fan's discharge or outlet radius and, using this radius in conjunction with the maximum allowable diffuser outer radius from above, determine the diffuser radius ratio (diffuser outlet radius/diffuser inlet radius);

5. The static pressure increase of the discharged, impelled fluid as it travels through the diffuser, attributable to the inventive diffuser, is given by the following equation:

delpstatic=ρ/2*(*V* tan fan^2(1−(*R*in/*R*out)^2)+*V*radfan^2(1−AreaRatio^(−2)))*(Regain Efficiency)

. . . where ρ is fluid density and RegainEfficiency is a function of the AreaRatio, or 6. The equation above can be solved by making assumptions as to certain unknown values (e.g., it can be assumed that the optimal area ratio is approximately equal to any value from 1.0 to 1.2, inclusive). Using a certain value for the area ratio, the resultant maximum efficiency can be approximated using Graph 7. The maximum efficiency ratio is relatively constant for a variety of speeds and sizes over an area ratio of 1.0 to 1.2. It may be desired to select a value from the lower side of this range to provide a safety factor against recirculation.

7. The static pressure increase of the discharged, impelled fluid as it travels through the diffuser, attributable to the inventive diffuser, can be approximated using the above equation (see Step 5). The estimated value of the pressure increase can then be used to determine the new value of static pressure from centrifugal fan generation alone (required fan static pressure) that is needed (simply by subtracting the static pressure increase attributable to the inventive diffuser from the required static pressure for the specific design application (determined in step 1)).

8. In the case where the inventive diffuser is to be retrofit onto an existing fan and it is not desired to increase the static pressure above that pressure already produced by the centrifugal fan, it must be determined what static pressure increase the fan alone must generate; this will be required fan static pressure. The new, smaller value of required fan static pressure from centrifugal fan generation alone (which, in addition to the static pressure increase attributable to the inventive diffuser results in the required static pressure for the design application) can be used to determine that more economical value (relative to any index to which a centrifugal fan's static pressure generation is sensitive, e.g., horsepower, fan blade angle, fan dimensions, fan speed, etc.) that will result in a centrifugal fan producing the necessary new, required fan static pressure generated from that centrifugal fan alone. For example, whereas before (i.e., without the inventive diffuser), a 100 horsepower centrifugal fan was required to produce the needed static pressure, perhaps now with the inventive diffuser, only a 85 horsepower fan is needed. Or perhaps the fan now only needs to operate at 2500 rpm, whereas without the inventive diffuser it would need to operate at 2800 rpm to produce the required static pressure. Perhaps a less expensive blade configuration can now be used. Perhaps a smaller dimensioned fan can now be used (usually, but perhaps not necessarily, within the same commercial family of fans), as may combinations of any of the above.

Instead of altering characteristics of a fan to be used with the inventive diffuser so that the unit produce the same design pressure merely an increase in the static pressure can be observed (e.g., in the case of a retrofit onto an existing fan that is to operate at the same speed.

9. The diffuser forms (or diffuser element) may then be made (using techniques well known to those in the art, and from materials well known to those in the art (including but not limited to solid or perforated plastic, solid or perforated metal, melamine or polyurethane open-cell foam material) to exhibit the diffuser inlet and outlet radii, and area ratio determined above. Opposing diffuser forms may be "mirror image" symmetric or not. Convergence may be effected in any manner including but not limited to conforming the inner walls of the diffuser forms to the "1/r" equation specified above.

An exemplary application of the above described algorithm to a particular design problem in order to size a fan and an inventive diffuser is as follows:

1. 29,000 cfm at 4.0 inches of water is to be provided in this specific example.

2. Using conventional centrifugal fan sizing techniques, the most efficient commercial airfoil plenum fan from Company A would be a 44.5 inch fan running at 899 rpm. It would consume 28.9 horsepower.

3. Because the outer limit of the 44.5 inch fan support frame is 51 inches, the maximum outer diameter of the diffuser can be assumed to be approximately 51 inches. Thus, our diffuser radius ratio is 51/44.5 and approximates 1.15. It should be noted that where appropriate, a fan support frame can be adjusted and resized as necessary.

4. In this example, due to the specific blade configuration, the swirl (tangential) velocity can be approximated as 60% of the wheel speed. The average radial velocity may be estimated from the flow through the fan and the lateral area (e.g., cross-sectional flow area) of the fan.

5. Regain efficiency can be assumed to peak at an area ratio of 1.2; from the graph it can be determined that the peak regain efficiency would be 90%. The graph shows typical results for a family of diffusers. Diffuser performance is a function of the inlet conditions (e.g. swirl velocity) and geometry. For the purposes of illustration it is convenient to fix the area ratio and diffuser efficiency. However, in general the efficiency could be calculated for specific velocity and geometry conditions.

6. Using the above values for regain efficiency, radial speed, tangential speed, diffuser outlet to inlet area ratio, diffuser outlet radius to diffuser inlet radius ratio, and a proper value for fluid density, the static pressure increase equation can be used to estimate the static pressure increase attributable to the diffuser.

7. Subtracting this increase from the diffuser, the static pressure required of the centrifugal fan can be determined. In this case, a next smaller fan in this commercial family is 40.2 inches in size. With a 51 inch shroud, the 40.2 inch fan would only need to produce 3.15 inches of pressure, and be run at 973 rpm. It would consume 24.9 horsepower (a reduction by 4.0 horsepower compared with the larger 44.5 inch fan without the diffuser). The power reduction in 14%, and a smaller motor size can be used.

8. Inapplicable here.

9. The specific shape of the converging diffuser could be made to conform to the 1/r equation specified above (or instead, it may have any of an infinite number of converging shapes).

This approach may be iterative because the velocity of the fan outlet fluid changes as the speed of the fan is changed and affects the pressure rise across the diffuser. The steps 4-9 may need to be repeated to adjust fan performance to satisfy the outlet conditions, as values for fan speed (which changes tangential velocity) may need to be updated repeatedly.

To achieve even better performance, the design of the fan and the design of the diffuser can be integrated to yield even better performance. For example, instead of limiting the choice of centrifugal fans to those that are currently commercially available, a custom-sized unit (where the size, fan speed, fan discharge axial length, and/or blade configuration, as but a few examples, are customized) can be designed.

It should be noted that the above described general method for sizing a centrifugal fan/diffuser unit is only one method. Another method may include a more complex method involving computational fluid dynamics.

As mentioned, at least one embodiment of the inventive technology affords termination of flow through the diffuser (when the centrifugal fan is not operating) through the use of movable (e.g., axially movable) diffuser forms that can sufficiently obstruct flow (including backflow or leakage through a fan) upon actuation. Methods involving movable forms may include the step of axially moving at least one of two oppositely established forms of the diffuser element toward the other to at least partially obstruct flow of discharged, impelled air.

At least one embodiment of the invention may be an impelled fluid diffusion apparatus 16 that comprises a first diffuser form 17 having a first impelled fluid directing side 18; and a second diffuser form 19 having a second impelled fluid directing side 20; and that does not comprise (or is without or does not include) vanes, wherein the first diffuser form and the second diffuser form may each be configured for establishment radially outward of a centrifugal fan so that the first impelled fluid directing side is substantially opposite the second impelled fluid directing side and so that at least a majority of fluid 21 impelled by the centrifugal fan passes between the first impelled fluid directing side and the second impelled fluid directing side. The first diffuser form and the second diffuser form may each be configured for establishment radially outward of a centrifugal fan so as to establish a diffuser inlet 22 and a diffuser outlet 23, wherein the first and second impelled fluid directing sides are closer at the diffuser outlet than at the diffuser inlet when the first and second diffuser forms are established opposite one another. In a preferred embodiment, the diffuser forms are not rotatable and do not rotate. It should be noted that the diffuser may diffuse substantially annularly about the centrifugal fan.

At least one embodiment of the invention may be an impelled fluid diffusion apparatus that comprises a first diffuser form having a first impelled fluid directing side; and a second diffuser form having a second impelled fluid directing side, wherein the first diffuser form and the second diffuser form may each be configured for establishment radially outward of a centrifugal fan so that the first impelled fluid directing side is substantially opposite the second impelled fluid directing side, so that at least a majority of fluid impelled by the centrifugal fan passes between the first impelled fluid directing side and the second impelled fluid directing side, and so as to define a diffuser inlet and outlet, wherein the first impelled fluid directing side and the second impelled fluid directing sides are physically closer (e.g., have a smaller axial separation) at the diffuser outlet than at the diffuser inlet when the first and second diffuser forms are established substantially opposite one another. In a preferred embodiment, the apparatus does not comprise (or is without or does not include) vanes, At least one embodiment of the invention is an impelled fluid diffusion apparatus that may comprise a first diffuser form having a first impelled fluid directing side and a second diffuser form having a second impelled fluid directing side; wherein the first impelled fluid directing side and the second impelled fluid directing side may define an impelled fluid directing profile 24, and a diffuser inlet and a diffuser outlet when the first impelled fluid diffuser form and the second diffuser form are established substantially opposite one another and radially outward of a centrifugal fan having a centrifugal fan impeller element 25, wherein the impelled fluid directing profile effects a decrease in the tangential velocity of, and a resultant increase in the static pressure of, a fluid impelled and discharged 26 by the centrifugal fan impeller element; wherein the impelled fluid directing profile also controls the radial velocity of the fluid impelled by the centrifugal fan and discharged by the centrifugal fan so as to avoid problems related to recirculation of a pressurized fluid 27 output from the radially outward established diffuser forms back into a space between the first and second impelled fluid directing sides. The radial velocity that may be controlled may be at the diffuser outlet and primarily the radial velocity of fluid adjacent the impelled fluid directing sides of the diffuser (because this is the most likely site of recirculation), although it is important to control all radial velocity at the diffuser outlet. The limit "so as to avoid problems related to recirculation . . . " is met where even one problem (e.g., reduction in increase in static pressure that would otherwise be observed) related to recirculation is avoided. It is of note that in a preferred embodiment, the apparatus might not comprise or include vanes.

At least one embodiment of the invention is an impelled air diffusion apparatus comprising a first diffuser form having a first impelled air directing side; and a second diffuser form having a second impelled air directing side; and not comprising vanes, wherein the first diffuser form and the second diffuser form is each configured for establishment radially outward of a centrifugal fan having a centrifugal fan axis of rotation 28, so that: (a) the first impelled air directing side and the second impelled air directing side are substantially opposite and converge as a radial distance form the centrifugal fan axis of rotation increases; (b) at least a majority of air impelled by the centrifugal fan passes between the first impelled air directing side and the second impelled air directing side; and (c) impelled air passing between the first impelled air directing side and the second impelled air directing side is output to a downflow air handling environment 29, and so as to: (d) radially extend an interface 30 through which the impelled air passing between the first impelled air directing side and the second impelled air directing side is output to the downflow air handling environment; (e) decrease a first velocity component 31 of the impelled air passing between the first impelled air directing side and the second impelled air directing side, wherein the first velocity component is substantially parallel to an interface through which the discharged, impelled air 32 is output to the downflow air handling environment, (f) increase the static pressure of the impelled air passing between the first impelled air directing side and the second impelled air directing side as a result of the decrease of the first velocity component of the impelled air; and (g) control a second velocity component 33 of the impelled air passing between the first impelled air directing side and the second impelled air directing side so as to avoid problems associated with recirculation of the impelled air output to a downflow air handling environment back into a space between the first impelled air directing side and the second impelled air directing side, wherein the second velocity component is substantially perpendicular to the interface through which the discharged, impelled air is output to the downflow air handling environment, and wherein the increase in static pressure is at least 90% the total increase in static pressure observed as the discharged, impelled air travels through the diffuser element 34.

In a preferred embodiment(s), the diffuser forms are symmetric about a plane 35 perpendicular to the centrifugal fan axis of rotation. Also, in a preferred embodiment(s) (as where the diffuser forms are symmetric about a plane perpendicular to the centrifugal fan axis of rotation), the first diffuser form and the second diffuser form may each be configured for establishment radially outward of a centrifugal fan to form a diffuser element, and so that a fluid impelled by the centrifugal fan is output from the diffuser element to a downflow fluid handling environment with a zero net velocity. However, other configurations (asymmetric configurations, e.g.—see FIGS. 9(*a*)-9(*d*)) are also within the ambit of the inventive technology. In a preferred embodiment(s), the first diffuser form and the second diffuser form is each configured to radially extend an interface through which the discharged, impelled fluid is output from the diffuser element established by the forms to a downflow fluid handling environment, which may be a scroll 36, and/or a plenum 37, and/or a flow-turning element 38, and/or ductwork 39, e.g. Such radial extension may effect a decrease of tangential velocity of impelled fluid passing between the first and second impelled fluid directing side.

Any scroll that is used in conjunction with the inventive diffuser may comprise a flow jetting, flow output section 40 that may serve to further diffuse the fluid. Such a scrolled system may be incorporated with the inventive diffuser (e.g., as where the diffuser is established between the centrifugal fan and the scroll housing), particularly where that scroll has a jetting diffusive section, and may per se effect a further reduction in noise output because such a design radially extends the point of separation of the scroll's jetting section from the axis of rotation of the centrifugal fan, as compared with a system not incorporating the inventive diffuser (as is well known, this point of separation is a significant generator of noise). Note that the term "flow turning element" is more directed to elements other than, e.g., a scroll, which are more appropriately viewed as flow collectors (however, of course, a scroll is a type of downflow fluid handling environment). A flow turning element is a type of downflow fluid handling environment that may be, e.g., an orthogonally turning flow turning element 41, to which the impelled fluid is responsive. It is of note that a flow turning element is typically found upstream of a plenum structure 42.

In a preferred embodiment(s), the impelled fluid is air, and the first and second impelled fluid directing sides are impelled air directing sides, but fluids other than air are deemed within the scope of the inventive technology. It should be noted that steps involving fluid including air (e.g., rotationally impelling fluid, or rotationally impelling air), and elements involving fluid, including air (e.g., an impelled fluid directing side, or an impelled air directing side) still apply where materials (e.g., particulates such as sawdust) are entrained or suspended in that fluid. The term impelled air (or more broadly, impelled fluid) directing side refers to a side that causes a directing of the flow in contact with it in a direction that is different, however slightly, from that direction in which the flow would travel in the absence of that impelled fluid directing side. The impelled fluid may be substantially uncompressed by the centrifugal fan, as its pressure may be increased by the fan and the diffuser by less than thirty inches of water Thus, the impelled fluid may have its static pressure increased approximately 50%, 100%, 200%, 300%, or perhaps even greater than as much as 400% compared to the inlet static pressure (the actual value may depend on inlet conditions and the size of the diffuser). It should be noted that as a gas may be a fluid, the fluid may be a gas (of course, including air).

The first and second impelled fluid directing sides may be shaped to effect optimal velocity pressure to static pressure transformation upon establishment substantially opposite one another. To achieve such optimal transformation (or merely to achieve any transformation), the first and the second impelled fluid directing sides may be closer (e.g., may have a smaller separation such as axial separation) at the diffuser outlet than at the diffuser inlet. It should be understood that axial refers to the axis of rotation of the centrifugal fan (or a line substantially parallel with this axis of rotation). If the separation of the impelled fluid directing sides at the diffuser outlet is sufficiently smaller than their separation at the diffuser inlet, the radial velocity of the impelled fluid will be sufficiently high at the diffuser outlet so as to prevent the aforementioned, undesired problems related to recirculation.

In considering the effect of the inside of the diffuser element (e.g., the first and the second impelled fluid directing sides) on the radial speed of the fluid output from it (a speed relevant to the prevention of recirculation), it should be understood that, as a preferred embodiment of the inventive diffuser is substantially annular in shape upon establishment radially outward of a centrifugal fan, the annular flow area defined by the diffuser will increase as radial distance increases (this presumes that the internal sides of the diffuser are parallel along their entire radial lengths, which they are not). Thus, configuring the diffuser such that the diffuser outlet spacing (e.g., the spacing between the diffuser forms at the diffuser outlet such as axial separation) is less than the diffuser inlet spacing will not necessarily increase the flow area (of the diffuser at its outlet as compared with the flow area at the diffuser inlet), and as a result will not necessarily increase the radial speed of the impelled fluid at its outlet as compared with it at its inlet. In order to increase the radial speed, convergence of the diffuser sides as radial distance from the centrifugal fan axis of rotation needs to be greater than a certain amount. However, in order to prevent recirculation, it has been determined that it is not necessary to always increase the radial speed of the fluid as it travels through the diffuser; indeed, in some circumstances, increasing the radial speed is unnecessary and is, in effect, a waste of valuable energy that could otherwise be realized as a valuable increase in static pressure. What is needed, in general, in order to prevent recirculation, is to output the fluid from the diffuser so that it is above a certain critical radial speed upon output (which may in fact be less than, substantially equal to, or greater than the radial speed of the fluid upon input to the diffuser). It has been determined that, for preferred embodiments, in order to prevent undesired recirculation, the radial speed of the impelled fluid output from the diffuser element needs to be greater than that speed observed when the sides of the differ element are parallel.

The extent to which the separation of the impelled fluid directing sides at the diffuser outlet should be smaller than their separation at the diffuser inlet is governed by predicted "recirculatory" flow behavior under expected operative design conditions and what is necessary to prevent such undesired recirculation or backflow of impelled fluid outside of the impelled fluid diffusion apparatus back into a space between the first and second impelled fluid directing sides. It may be that it is necessary only that the diffuser has impelled fluid directing sides that are closer at the diffuser outlet than at the diffuser inlet only by that amount necessary to assure that the radial speed at diffuser outlet is kept above a certain limit (which may even be less than the radial speed at diffuser inlet!), in order that the radial velocity of the impelled fluid at the diffuser outlet is sufficient to prevent recirculation. In any design, the impelled fluid directing sides may converge towards one another in a direction parallel with the axis of rotation of the fan. The side(s) may exhibit such axial convergence at only certain range(s) of radial distance from the axis of rotation (see, e.g., FIG. 9(*e*)) of the centrifugal fan, or they may exhibit such convergence along substantially the entire radial length of the diffuser. Two sides are said to converge towards one another even where only one side "moves" towards the other as the radial distance from a centrifugal fan axis of rotation increases (while the other side is, e.g., substantially orthogonal to the centrifugal fan axis of rotation). One side may be strictly orthogonal to the axis of rotation along its entire radial length while the other side may converge towards this side (see, e.g., FIGS. 9(*c*) and 9(*d*)), or both sides may converge towards each other. To converge, the diffuser need only have a side that has any portion(s) (or an entire side length) that moves towards the other side as a radial distance from the axis of rotation of the fan increases, whether that portion or length be curved or straight. Indeed, whenever the diffuser outlet has a smaller separation at its opening than has the diffuser inlet, there has been convergence.

In a preferred design, there is no radial portion of the sides that diverge. Indeed, in a preferred design, the sides do not define a "pinchpoint". In at least one embodiment, the first and second impelled fluid directing sides of the diffuser forms axially converge along at least a radial portion of the apparatus. In sum, the first and second impelled fluid directing sides may be shaped to decrease the tangential velocity and to control radial velocity by increasing, maintaining, or keeping it above a certain lower limit, but preferably only by substantially that amount necessary to just avoid recirculation (e.g., where the radial velocity or speed is kept only slightly above the limit at which problems related to recirculation begin, this limit typically being determined experimentally for various specific applications (e.g., specific fan speeds)). The apparatus, in any embodiment, may further comprise acoustical material that is established outside the first impelled air directing side and the second impelled air directing side to reduce noise, and/or the apparatus may comprise a diffuser element or diffuser form(s) that themselves are made from (in at least sufficient part) acoustic material.

In at least one embodiment of the invention, an impelled air diffusion apparatus comprises: a first diffuser form having a first impelled air directing side; and a second diffuser form having a second impelled air directing side; acoustical material established outside of and substantially contiguously with the first and second impelled fluid directing side, and does not comprise (or is without) vanes, wherein the first diffuser form and the second diffuser form is each configured for establishment radially outward of a centrifugal fan having a centrifugal fan impeller element so that: (a)the first impelled air directing side is substantially opposite and axially converges toward the second impelled air directing side along at least a radial portion of the impelled air diffusion apparatus; (b) at least a majority of air impelled by the centrifugal fan passes between the first impelled air directing side and the second impelled air directing side; and (c) impelled air passing between the first impelled air directing side and the second impelled air directing side is output to a plenum, wherein the first diffuser form and the second diffuser form is each configured to radially extend an interface through which air impelled by the centrifugal fan impeller element is output to the plenum so as to decrease the tangential velocity of the impelled air passing between the first impelled air directing side and the second impelled air directing side, thereby increasing the static pressure of the impelled air passing between the first impelled air directing side and the second impelled air directing side.

In at least one embodiment of the invention, an impelled air diffusion apparatus comprises: a first diffuser form having a first impelled air directing side; and a second diffuser form having a second impelled air directing side; and does not comprise vanes, wherein the first diffuser form and the second diffuser form is each configured for establishment radially outward of a centrifugal fan having a centrifugal fan axis of rotation, so that: (a) at least a majority of air impelled by the centrifugal fan passes between the first impelled air directing side and the second impelled air directing side; and (b) impelled air passing between the first impelled air directing side and the second impelled air directing side is output to a downflow air handling environment, and so as to: (c) decrease a first velocity component of the impelled air passing between the first impelled air directing side and the second impelled air directing side, wherein the first velocity component is substantially parallel to an interface through which the discharged, impelled air is output to the downflow air handling environment, (d) increase the static pressure of the impelled air passing between the first impelled air directing side and the second impelled air directing side as a result of the decrease of the first velocity component of the impelled air; and (e) control a second velocity component of the impelled air passing between the first impelled air directing side and the second impelled air directing side so as to avoid problems associated with recirculation of the impelled air output to the downflow air handling environment back into a space between the first impelled air directing side and the second impelled air directing side, wherein the second velocity component is substantially perpendicular to the interface through which the discharged, impelled air is output to the downflow air handling environment, and wherein the increase in static pressure is at least 90% the total increase in static pressure observed as the discharged, impelled air travels through the diffuser element.

At least one embodiment of the invention may be a fluid handling method comprising the steps of accepting fluid into a centrifugal fan having a centrifugal fan impeller element and a centrifugal fan axis of rotation; rotationally impelling the fluid through use of the centrifugal fan impeller element; imparting a centrifugal force to the fluid; discharging the impelled fluid into a diffuser element; axially converging the discharged, impelled fluid as a radial distance from the centrifugal axis of rotation increases; transforming velocity pressure of the discharged, impelled fluid to static pressure; increasing static pressure of the discharged, impelled fluid; and outputting the discharged, impelled fluid to a downflow fluid handling environment.

At least one embodiment of the invention is an impelled fluid output diffusion method that comprises the steps of receiving through a diffuser inlet of a diffuser element a fluid impelled by a centrifugal fan and having a tangential velocity and a radial velocity; decreasing the tangential velocity of the fluid impelled by a centrifugal fan; increasing static pressure of the impelled fluid as a result of the step of decreasing the tangential velocity; controlling radial velocity of the fluid impelled by a centrifugal fan; and outputting the fluid impelled by the centrifugal fan through a diffuser outlet of the diffuser to a downflow fluid handling environment; wherein the step of controlling radial velocity of the fluid impelled by a centrifugal fan may comprise the step of doing so in order to avoid problems related to recirculation of the impelled fluid output to the downflow fluid handling environment back into a space defined by the diffuser element.

The step of outputting the impelled fluid may include outputting fluid with a zero net velocity, as the case where the diffuser sides are symmetric about a plane orthogonal to the axis of rotation of the centrifugal fan. Transforming velocity pressure of the impelled fluid to static pressure or the step of decreasing tangential velocity of the impelled fluid may include radially extending an interface through which impelled fluid is output to a downflow fluid handling environment. In a preferred embodiment(s), the step of accepting fluid into a centrifugal fan comprises the step of accepting air into the fan. The step of rotationally impelling fluid may comprise the step of impelling fluid without substantially compressing it, as where the pressure of the fluid impelled by the centrifugal fan is increased by less than 30 inches of water.

In at least one embodiment, the step of outputting impelled fluid to a downflow fluid handling environment may include outputting fluid to a scroll; this method perhaps further including jetting fluid output from a scroll by increasing the cross-sectional flow area of the scroll. In at least one embodiment, outputting the impelled fluid to a downflow fluid handling environment may include outputting the impelled fluid to a plenum and/or to a flow turning element (e.g., an orthogonally turning flow turning element)

that then may output to a plenum. Embodiments may include intermediately outputting impelled air to a flow turning element (that then outputs it to a plenum). Note that a fluid may be considered output to a plenum even where it is first output to a different device (e.g., a flow turning element).

In at least one embodiment of the instant inventive technology, an air handling method comprises the steps of: accepting air into a centrifugal fan having a centrifugal fan impeller element; rotationally impelling the air through use of the centrifugal fan impeller element; imparting a centrifugal force to the air; discharging the impelled air into a diffuser element; transforming tangential velocity pressure of the discharged, impelled air to static pressure without using vanes and by decreasing tangential velocity of the discharged, impelled air; increasing static pressure of the discharged, impelled air as a result of the step of decreasing tangential velocity of the discharged, impelled air; outputting the discharged, impelled air to a downflow air handling environment; and sufficiently controlling radial velocity of the discharged, impelled air as it travels through the diffuser element so as to avoid a problem related to recirculation (that recirculation being recirculation of the discharged, impelled air output to the downflow air handling environment back into the diffuser element), wherein the step of transforming tangential velocity pressure comprises the step of radially extending an interface through which the discharged, impelled air is output to the downflow air handling environment, and wherein the step of sufficiently controlling radial velocity of discharged, impelled air comprises the step of axially converging the discharged, impelled air.

In at least one embodiment of the invention, a fluid handling method comprises the steps of: accepting fluid into a centrifugal fan having a centrifugal fan axis of rotation and a centrifugal fan impeller element; rotationally impelling the fluid through use of a centrifugal fan impeller element; imparting a centrifugal force to the fluid; discharging the impelled fluid into a diffuser element; axially converging the discharged, impelled fluid as a radial distance from the centrifugal axis of rotation increases; transforming tangential velocity pressure of the discharged, impelled fluid to static pressure; increasing static pressure of the discharged, impelled fluid; and outputting the discharged, impelled fluid to a downflow fluid handling environment.

Any of the methods may further comprise the step of establishing acoustical material to reduce noise attributable to the centrifugal fan and/or the diffuser and/or any scroll that may exist (as but three sources); such material may be established substantially externally of and/or as at least a part of, the diffuser forms.

At least one embodiment of the invention may be a fluid handling method that comprises the steps of: accepting fluid into a centrifugal fan having a centrifugal fan axis of rotation and a centrifugal fan impeller element; rotationally impelling the fluid through use of a centrifugal fan impeller element; imparting a centrifugal force to the fluid; discharging the impelled fluid into a diffuser element; transforming tangential velocity pressure of the discharged, impelled fluid to static pressure with a regain efficiency of at least 70%; increasing static pressure of the discharged, impelled fluid as a result of the step of transforming tangential velocity pressure of the discharged, impelled fluid to static pressure; and outputting the discharged, impelled fluid to a downflow fluid handling environment, wherein transforming tangential velocity pressure to static pressure comprises the step of transforming tangential velocity pressure to effect at least 90% of the total increase in static pressure observed as the discharged, impelled air travels through the diffuser element.

At least one embodiment of the invention may be an air handling method that comprises the steps of: accepting air into a centrifugal fan having a centrifugal fan impeller element; rotationally impelling the air through use of the centrifugal fan impeller element; imparting a centrifugal force to the air; discharging the impelled air into a diffuser element; transforming tangential velocity pressure of the discharged, impelled air to static pressure without using vanes and by decreasing tangential velocity; increasing static pressure of the discharged, impelled air; sufficiently controlling radial velocity of the impelled air so as to avoid problems related to recirculation of the discharged, impelled air output to the downflow air handling environment; outputting the discharged, impelled air to a plenum; and establishing acoustical material substantially outside of and contiguously with the diffuser element, wherein the step of transforming tangential velocity pressure of the discharged, impelled air comprises the step of radially extending an interface through which the discharged, impelled air is output to the plenum, and wherein the step of sufficiently controlling radial velocity of discharged, impelled air comprises the step of axially converging the discharged, impelled air, and wherein the recirculation is recirculation of the discharged impelled air output to a plenum back into as space defined by the diffuser element.

Transforming velocity pressure of the impelled fluid to static pressure may be optimal and may include decreasing tangential velocity of the impelled fluid and controlling radial velocity of the impelled fluid as it passes through the diffuser element (perhaps keeping radial velocity at or above that value adequate or necessary to just avoid problems related to recirculation of fluid in the downflow fluid handling environment (e.g., a plenum space) back into the diffuser).

The steps of decreasing the tangential velocity of the fluid impelled by a centrifugal fan and controlling radial velocity of the fluid impelled by a centrifugal fan may each be performed without vanes (of course, any disclaim of vaned designs is a disclaim of only those designs that include functional vanes that actually effect some static recovery).

The step of axially converging the impelled fluid discharged into the diffuser element may comprise the step of continuously (as opposed to repeatedly and/or intermittently) axially converging the impelled fluid; such continual convergence may be along only a portion(s) of the radial length of the diffuser element, or along substantially the entire radial length of the diffuser element. The step of axially converging the impelled fluid discharged into the diffuser element may comprise the step of converging without exhibiting a side profile having or defining a pinch point.

Particularly where the transformation of velocity pressure is optimal (including substantially so), the step of controlling radial velocity may comprise controlling the radial velocity so that at the outlet from the diffuser the impelled fluid has a radial velocity that is substantially only that amount just necessary to avoid the undesired problems related to recirculation described above (i.e., that just avoids recirculation). In at least one embodiment (indeed, preferred embodiment(s)), the step of transforming velocity pressure of the impelled fluid into static pressure is performed without vanes, as where substantially all energy transformed from diffuser inlet to diffuser outlet is transformed without the use of vanes or where no part of the energy is transformed using vanes.

As used in the claims, "responsive to" takes on its ordinary definition of "reacts to"; when a first element is "responsive to" a second element, then a stimulus in the second element may cause a reaction in the first element. Associative use of the term "responsive to" (or variant forms such as "responds to" or "to which_is responsive", as but only two other examples) often, but not always, implies some type of structural connection or physical contact, however indirect, between the elements associated.

As can be easily understood from the foregoing, the basic concepts of the present invention may be embodied in a variety of ways. It involves both diffusion techniques as well as devices to accomplish the appropriate diffusion. In this application, the diffusion techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this patent application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims which will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied on for support of the application's claims.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "diffuser" should be understood to encompass disclosure of the act of "diffusing"—whether explicitly discussed or not—and, conversely, were there effectively disclosure of the act of "diffusing", such a disclosure should be understood to encompass disclosure of a "diffuser" and even a "means for diffusing" Such changes and alternative terms are to be understood to be explicitly included in the description.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the diffuser devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, and xii) each potentially dependent claim or concept as a dependency on each and every one of the independent claims or concepts presented.

With regard to claims whether now or later presented for examination, it should be understood that for practical reasons and so as to avoid great expansion of the examination burden, the applicant may at any time present only initial claims or perhaps only initial claims with only initial dependencies. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. An impelled air diffusion apparatus comprising a first diffuser form having a first impelled air directing side; and a second diffuser form having a second impelled air directing side;

and not comprising vanes, wherein said first diffuser form and said second diffuser form is each configured for establishment radially outward of a centrifugal fan having a centrifugal fan axis of rotation, so that:

(a) said first impelled air directing side and said second impelled air directing side are substantially opposite and converge as a radial distance from said centrifugal fan axis of rotation increases;

(b) at least a majority of air impelled by said centrifugal fan passes between said first impelled air directing side and said second impelled air directing side; and (c) impelled air passing between said first impelled air directing side and said second impelled air directing side is output to a downflow air handling environment, and so as to:

(d) radially extend an interface through which said impelled air passing between said first impelled air directing side and said second impelled air directing side is output to said downflow air handling element;

(e) decrease a first velocity component of said impelled air passing between said first impelled air directing side and said second impelled air directing side, wherein said first velocity component is substantially parallel to an interface through which the discharged, impelled air is output to said downflow air handling environment;

(f) increase the static pressure of said impelled air passing between the first impelled air directing side and the second impelled air directing side as a result of said decrease of the first velocity component of said impelled air;

(g) control a second velocity component of said impelled air passing between the first impelled air directing side and the second impelled air directing side so as to avoid recirculation of said impelled air output to a downflow air handling environment back into a space between said first impelled air directing side and said second impelled air directing side, and (h) a flow turning element to which said impelled air is responsive, wherein said second velocity component is substantially perpendicular to said interface through which said discharged, impelled air is output to said downflow air handling environment, wherein said increase in static pressure is at least 90% the total increase in static pressure observed as said discharged, impelled air travels through said diffuser element, and wherein said downflow air handling environment comprises a plenum.

2. An impelled air diffusion apparatus as described in claim 1 wherein said impelled air passing between said first impelled air directing side and said second impelled air directing side is output from said impelled air diffusion apparatus to a downflow air handling environment with a zero net velocity.

3. An impelled air diffusion apparatus as described in claim 1 wherein said centrifugal fan has a fan blade outlet angle selected to enhance an increase in said static pressure.

4. An impelled air diffusion apparatus as described in claim 1 wherein said flow turning element comprises an orthogonally turning flow turning element.

5. An impelled air diffusion apparatus as described in claim 1 wherein a diffuser outlet area and a diffuser inlet area defined by said first impelled air directing side and said second impelled air directing side are approximately equal.

6. An impelled air diffusion apparatus as described in claim 1 further comprising said centrifugal fan.

7. An impelled fluid diffusion apparatus comprising:

a first diffuser form having a first impelled fluid directing side; and a second diffuser form having a second impelled fluid directing side;

wherein said first diffuser form and said second diffuser form is each configured for establishment radially outward of a centrifugal fan having a centrifugal fan axis of rotation so that said first impelled fluid directing side is substantially opposite said second impelled fluid directing side and so that at least a majority of fluid impelled by said centrifugal fan passes between said first impelled fluid directing side and said second impelled fluid directing side, wherein said first impelled fluid directing side and said second impelled fluid directing side define a diffuser inlet and a diffuser outlet, wherein said first impelled fluid directing side and said second impelled fluid directing side physically closer at said diffuser outlet than at said diffuser inlet, and wherein said downflow fluid handling environment comprises a flow turning element that outputs to a plenum.

8. An impelled fluid diffusion apparatus as described in claim 7 wherein said first diffuser form and said second diffuser form is each configured to radially extend an interface through which said impelled fluid is output to a downflow fluid handling environment when established radially outward of a centrifugal fan.

9. An impelled fluid diffusion apparatus as described in claim 7 wherein said centrifugal fan has a fan blade outlet angle selected to enhance an increase in said static pressure.

10. An impelled fluid diffusion apparatus as described in claim 7 wherein said flow turning element comprises an orthogonally turning flow turning element.

11. An impelled fluid diffusion apparatus comprising:

a first diffuser form having a first impelled fluid directing side; and a second diffuser form having a second impelled fluid directing side;

wherein said first impelled fluid directing side and said second impelled fluid directing side define an impelled fluid directing profile when said first impelled fluid diffuser form and said second diffuser form are established substantially opposite one another and radially outward of a centrifugal fan having a centrifugal fan impeller element, wherein said first impelled fluid directing side and said second impelled fluid directing side define a diffuser inlet and a diffuser outlet;

wherein said impelled fluid directing profile effects a decrease in the tangential velocity of, and a resultant increase in the static pressure of a fluid impelled and discharged by said centrifugal fan impeller element when said first impelled fluid diffuser form and said second diffuser form are established radially outward of a centrifugal fan and substantially opposite one another, wherein said impelled fluid directing profile controls the radial velocity of said fluid impelled and discharged by said centrifugal fan impeller element so as to avoid recirculation of a pressurized fluid output from said radially outward established diffuser forms back into a space between said first and second impelled fluid directing sides, and wherein said downflow fluid handling environment comprises a flow turning element that outputs said impelled fluid to a plenum.

12. An impelled fluid diffusion apparatus as described in claim 11 wherein said impelled fluid directing profile controls the radial velocity of said fluid impelled by said centrifugal fan and discharged by said centrifugal fan so as to just avoid recirculation of a pressurized fluid output.

13. An impelled fluid diffusion apparatus as described in claim 11 wherein said first diffuser form and said second diffuser form is each configured to radially extend an interface through which an impelled fluid is output to a downflow fluid handling environment.

14. An impelled fluid diffusion apparatus as described in claim 11 further comprising acoustical material established to reduce noise.

15. An impelled fluid diffusion apparatus as described in claim 11 wherein said impelled fluid comprises air.

16. An impelled air diffusion apparatus comprising a first diffuser form having a first impelled air directing side; and a second diffuser form having a second impelled air directing side;

acoustical material established outside of and substantially contiguously with said first impelled air directing side and said second impelled air directing side, and not comprising vanes, wherein said first diffuser form and said second diffuser form is each configured for establishment radially outward of a centrifugal fan having a centrifugal fan impeller element so that:

(a) said first impelled air directing side is substantially opposite and axially converges toward said second impelled air directing side along at least a radial portion of said impelled air diffusion apparatus;

(b) at least a majority of air impelled by said centrifugal fan passes between said first impelled air directing side and said second impelled air directing side; and (c) impelled air passing between said first impelled air directing side and said second impelled air directing side is output to a plenum, wherein said first diffuser form and said second diffuser form is each configured to radially extend an interface through which air impelled by said centrifugal fan impeller element is output to said plenum so as to decrease the tangential velocity of said impelled air passing between said first impelled air directing side and said second impelled air directing side, thereby increasing the static pressure of said impelled air passing between said first impelled air directing side and said second impelled air directing side.

17. An impelled air diffusion apparatus as described in claim 16 wherein said output to a plenum has a zero net velocity.

18. An impelled air diffusion apparatus as described in claim 16 wherein said first impelled air directing side is substantially opposite and axially converges toward said second impelled air directing side.

19. An impelled air diffusion apparatus as described in claim 16 wherein said centrifugal fan has forwardly curved impeller blades.

20. An impelled air diffusion apparatus comprising a first diffuser form having a first impelled air directing side; and a second diffuser form having a second impelled air directing side; and not comprising vanes, wherein said first diffuser form and said second diffuser form is each configured for establishment radially outward of a centrifugal fan having a centrifugal fan axis of rotation, so that:

(a) at least a majority of air impelled by said centrifugal fan passes between said first impelled air directing side and said second impelled air directing side; and (b) impelled air passing between said first impelled air directing side and said second impelled air directing side is output to a downflow air handling environment, and so as to:

(c) decrease a first velocity component of said impelled air passing between the first impelled air directing side and the second impelled air directing side, wherein said first velocity component is substantially parallel to an interface through which said discharged, impelled air is output to said downflow air handling environment, (d) increase the static pressure of said impelled air passing between the first impelled air directing side and the second impelled air directing side as a result of said decrease of said first velocity component of said impelled air; and (e) control a second velocity component of said impelled air passing between the first impelled air directing side and the second impelled air directing side so as to avoid recirculation of said impelled air output to said downflow air handling environment back into a space between said first impelled air directing side and said second impelled air directing side, wherein said second velocity component is substantially perpendicular to said interface through which said discharged, impelled air is output to said downflow air handling environment, and wherein said increase in static pressure is at least 90% the total increase in static pressure observed as said discharged, impelled air travels through said diffuser element.

21. An impelled air diffusion apparatus as described in claim 20 wherein said centrifugal fan comprises forwardly curved impeller blades.

* * * * *